US008413785B2

(12) United States Patent
Hattori et al.

(10) Patent No.: US 8,413,785 B2
(45) Date of Patent: Apr. 9, 2013

(54) BANKNOTE STORAGE AND BANKNOTE HANDLING MACHINE

(75) Inventors: Hirokazu Hattori, Hyogo (JP); Minoru Nagano, Hyogo (JP)

(73) Assignee: Glory Ltd., Himeji-shi (JP)

( * ) Notice: Subject to any disclaimer, the term of this patent is extended or adjusted under 35 U.S.C. 154(b) by 0 days.

(21) Appl. No.: 12/663,150

(22) PCT Filed: Jun. 6, 2007

(86) PCT No.: PCT/JP2007/061471

§ 371 (c)(1),
(2), (4) Date: Dec. 4, 2009

(87) PCT Pub. No.: WO2008/149433

PCT Pub. Date: Dec. 11, 2008

(65) Prior Publication Data

US 2010/0174402 A1 Jul. 8, 2010

(51) Int. Cl.
*G07F 7/04* (2006.01)

(52) U.S. Cl. ..... 194/206

(58) Field of Classification Search ..... 232/7, 8, 232/10, 11, 15, 16; 235/379; 209/534; 902/8, 902/9, 10, 11, 12, 13; 194/205, 206, 207, 194/210, 215, 216, 217; 700/215; 271/145, 271/147, 165

See application file for complete search history.

(56) References Cited

U.S. PATENT DOCUMENTS

| | | | | |
|---|---|---|---|---|
| 5,105,364 | A * | 4/1992 | Kawamura et al. | 700/219 |
| 6,980,684 | B1 | 12/2005 | Munro et al. | |
| 2004/0011622 | A1 | 1/2004 | Omori et al. | |
| 2005/0060061 | A1 | 3/2005 | Jones et al. | |

FOREIGN PATENT DOCUMENTS

| | | | |
|---|---|---|---|
| CN | 1462985 | A | 12/2003 |
| EP | 1 517 275 | A1 | 3/2005 |
| JP | 2-21393 | A | 1/1990 |
| JP | 2685817 | B2 | 8/1997 |
| JP | 2002-329235 | A | 11/2002 |

* cited by examiner

*Primary Examiner* — Mark Beauchaine
(74) *Attorney, Agent, or Firm* — Foley & Lardner LLP

(57) ABSTRACT

A banknote storage includes a memory unit that stores therein number-of-sheets information for banknotes stored in the banknote storage by denomination being a kind of the banknotes and by category being a classification based on a feature amount of the banknotes. Categories represent classifications when the banknotes are classified by their features. In five classifications defined by ECB, the banknote is classified into two depending on whether the banknote is genuine or counterfeit, and the former is called a genuine note and the latter is called a rejected note. The genuine note is further classified into two depending on how the genuine note is damaged, and one of them without any trouble in its usage is called a fit note and the other one with any trouble assumed in its usage because of being largely damaged is called an unfit note.

10 Claims, 10 Drawing Sheets

STORAGE-MANAGEMENT-TABLE MEMORY

| MOUNTING-LOCATION IDENTIFICATION INFORMATION | STORAGE IDENTIFICATION INFORMATION | STORED-DENOMINATION INFORMATION | NUMBER-OF-SHEETS INFORMATION | | | | | |
|---|---|---|---|---|---|---|---|---|
| | | | DENOMINATION INFORMATION | CLASSIFICATION INFORMATION | | | | |
| | | | | FIRST CATEGORY | SECOND CATEGORY | THIRD CATEGORY | FOURTH CATEGORY | FIFTH CATEGORY |
| A | 1 | ALL DENOMINATIONS | 1000 YEN | 0 | 3 | 0 | 0 | 0 |
| | | | 5000 YEN | 0 | 1 | 0 | 0 | 0 |
| | | | 10000 YEN | 0 | 5 | 4 | 2 | 0 |
| | | | DENOMINATION INFORMATION | CLASSIFICATION INFORMATION | | | | |
| | | | | FIRST CATEGORY | SECOND CATEGORY | THIRD CATEGORY | FOURTH CATEGORY | FIFTH CATEGORY |
| B | 2 | 1000 YEN | 1000 YEN | 100 | 0 | 0 | 0 | 0 |
| | | | 5000 YEN | 0 | 0 | 0 | 0 | 0 |
| | | | 10000 YEN | 0 | 0 | 0 | 0 | 0 |
| | | | DENOMINATION INFORMATION | CLASSIFICATION INFORMATION | | | | |
| | | | | FIRST CATEGORY | SECOND CATEGORY | THIRD CATEGORY | FOURTH CATEGORY | FIFTH CATEGORY |
| C | 3 | 5000 YEN | 1000 YEN | 0 | 0 | 0 | 0 | 0 |
| | | | 5000 YEN | 100 | 0 | 0 | 0 | 0 |
| | | | 10000 YEN | 0 | 0 | 0 | 0 | 0 |
| | | | DENOMINATION INFORMATION | CLASSIFICATION INFORMATION | | | | |
| | | | | FIRST CATEGORY | SECOND CATEGORY | THIRD CATEGORY | FOURTH CATEGORY | FIFTH CATEGORY |
| D | 4 | 10000 YEN | 1000 YEN | 0 | 0 | 0 | 0 | 0 |
| | | | 5000 YEN | 0 | 0 | 0 | 0 | 0 |
| | | | 10000 YEN | 100 | 0 | 0 | 0 | 0 |

BANKNOTE-MANAGEMENT-TABLE MEMORY

| DENOMINATION INFORMATION | CLASSIFICATION INFORMATION | | | | |
|---|---|---|---|---|---|
| | 1 | 2 | 3 | 4 | 5 |
| 1000 YEN | 20 | 1 | 0 | 0 | 0 |
| 5000 YEN | 6 | 0 | 0 | 0 | 0 |
| 10000 YEN | 30 | 2 | 40 | 0 | 0 |

FIG.7

STORAGE-MANAGEMENT-TABLE MEMORY

| MOUNTING-LOCATION IDENTIFICATION INFORMATION | STORAGE IDENTIFICATION INFORMATION | STORED-DENOMINATION INFORMATION | NUMBER-OF-SHEETS INFORMATION | | | | | |
|---|---|---|---|---|---|---|---|---|
| | | | DENOMINATION INFORMATION | CLASSIFICATION INFORMATION | | | | |
| | | | | FIRST CATEGORY | SECOND CATEGORY | THIRD CATEGORY | FOURTH CATEGORY | FIFTH CATEGORY |
| A | 1 | ALL DENOMINATIONS | 1000 YEN | 0 | 3 | 0 | 0 | 0 |
| | | | 5000 YEN | 0 | 1 | 0 | 0 | 0 |
| | | | 10000 YEN | 0 | 5 | 4 | 2 | 0 |
| | | | DENOMINATION INFORMATION | CLASSIFICATION INFORMATION | | | | |
| | | | | FIRST CATEGORY | SECOND CATEGORY | THIRD CATEGORY | FOURTH CATEGORY | FIFTH CATEGORY |
| B | 2 | 1000 YEN | 1000 YEN | 100 | 0 | 0 | 0 | 0 |
| | | | 5000 YEN | 0 | 0 | 0 | 0 | 0 |
| | | | 10000 YEN | 0 | 0 | 0 | 0 | 0 |
| | | | DENOMINATION INFORMATION | CLASSIFICATION INFORMATION | | | | |
| | | | | FIRST CATEGORY | SECOND CATEGORY | THIRD CATEGORY | FOURTH CATEGORY | FIFTH CATEGORY |
| C | 3 | 5000 YEN | 1000 YEN | 0 | 0 | 0 | 0 | 0 |
| | | | 5000 YEN | 100 | 0 | 0 | 0 | 0 |
| | | | 10000 YEN | 0 | 0 | 0 | 0 | 0 |
| | | | DENOMINATION INFORMATION | CLASSIFICATION INFORMATION | | | | |
| | | | | FIRST CATEGORY | SECOND CATEGORY | THIRD CATEGORY | FOURTH CATEGORY | FIFTH CATEGORY |
| D | 4 | 10000 YEN | 1000 YEN | 0 | 0 | 0 | 0 | 0 |
| | | | 5000 YEN | 0 | 0 | 0 | 0 | 0 |
| | | | 10000 YEN | 100 | 0 | 0 | 0 | 0 |

BANKNOTE STORAGE AND BANKNOTE HANDLING MACHINE

TECHNICAL FIELD

The present invention relates to a banknote storage mounted on a banknote handling machine that manages depositing and dispensing of banknotes, and the banknote handling machine mounted with the banknote storage.

BACKGROUND ART

Conventionally, ATM (Automated Teller Machine) that accepts a specified operation by a user to dispense cash and perform bank transfer is installed in banking facilities or the like, and a banknote handling machine mounted inside the ATM manages depositing and dispensing of banknotes. More specifically, the banknote handling machine includes a storage for storing therein banknotes, and stores therein the number of banknotes stored in the storage for each denomination. For example, Patent Document 1 discloses an automated teller machine that provides a memory in a storage and stores the number of banknotes stored in the storage in the memory for each denomination.

In recent years, the automated teller machine determines to which classification of five classified categories a banknote inserted by a user corresponds. The categories are explained herein. A banknote is largely classified into two depending on whether the banknote is genuine or counterfeit, and the former is called "genuine note" and the latter is called "counterfeit note". The genuine note is further classified into two depending on how the genuine note is damaged, and one of them without any trouble in its usage is called "fit note" and the other one with any trouble assumed in its usage because of being largely damaged is called "unfit note". Consequently, the automated teller machine determines to which classification of the five classified categories the banknote inserted by the user corresponds, the categories including "genuine note and fit note", "genuine note and unfit note", "counterfeit note", "suspect note" indicating that the banknote cannot be clearly determined as the genuine note, and "rejected note" determined when two banknotes overlap each other upon determination of the categories or when the banknote is not placed properly on the recognition/determination unit.

When the banknote is inserted by the user, the automated teller machine recognizes and determines the banknote and determines to which classification of the five categories the banknote corresponds. The banknote determined as any one of "counterfeit note", "suspect note", and "rejected note" is returned to the user. Meanwhile, there is also an automated teller machine that collects banknotes determined as "counterfeit note" or "suspect note", and the collected banknotes are used afterward for various investigations (such as for identifying the user) and for proof of criminal acts.

Patent Document 1: Japanese Patent No. 2685817

DISCLOSURE OF INVENTION

Problem to be Solved by the Invention

However, the conventional technology has a problem that the number of banknotes stored in the storage cannot be determined by denomination and by category. In other words, number-of-sheets information for the banknotes stored inside the storage is stored therein by denomination but the number-of-sheets information for the banknotes by category is not stored therein. In addition, the banknote handling machine manages the number-of-sheets information for the banknotes stored in the storage provided in itself by denomination but does not manage the number-of-sheets information by category. As a result, there is also a problem that trace information is not enough to identify the user when the counterfeit note or the suspect note is used and even if it is taken into the inside of the banknote handling machine.

The present invention has been therefore made to solve some problems based on the conventional technology, and it is an object of the present invention to provide a banknote storage and a banknote handling machine capable of determining the number of banknotes stored in the storage by denomination and by category.

Means for Solving Problem

According to an aspect of the invention, a banknote storage mounted on a banknote handling machine that manages depositing and dispensing of a banknote, and includes a memory unit that stores therein number-of-sheets information for banknotes stored inside of the banknote storage by denomination being a kind of the banknotes and by category being a classification based on a feature quantity of the banknotes.

The banknote storage may further include a communication unit that writes, when accepting a write instruction of number-of-sheets information to the memory unit from an external device, the number-of-sheets information to the storage unit based on the write instruction, and that reads, when accepting a read instruction of number-of-sheets information of the memory unit from the external device, the number-of-sheets information from the memory unit based on the read instruction, and transmits the read information to the external device.

In the banknote storage, the memory unit may store therein the number-of-sheets information by category, the category being classified into a first category as a genuine and fit note, a second category as a genuine and unfit note, a third category as a suspect note, a fourth category as a counterfeit note, and a fifth category as a rejected note, based on a combination of a first feature quantity indicating a shape of the banknote as an optical feature quantity obtained by optically measuring the banknote, a second feature quantity indicating an amount or a wavelength of transmissive light or reflected light through/by the banknote, and a third feature quantity indicating a magnetic content contained in the banknote as a magnetic feature quantity obtained by magnetically measuring the banknote.

In the banknote storage, the memory unit may store therein the number-of-sheets information by category, the category being classified into a first category as a genuine and fit note, a second category as a genuine note and a unfit note, a third category as a suspect note, a fourth category as a counterfeit note, and a fifth category as a rejected note, based on a combination of a first feature quantity indicating corner-fold or an amount of a missing part of the banknote as an optical feature quantity obtained by optically measuring the banknote, a second feature quantity indicating an attenuation of infrared rays of transmissive light or reflected light through/by the banknote, and a third feature quantity indicating a magnetic content contained in a serial-number printed portion, a portrait portion, and a denomination printed portion on the banknote, as a magnetic feature quantity obtained by magnetically measuring the banknote.

According to another aspect of the invention, a banknote handling machine manages depositing and dispensing of a banknote, and includes a recognizing unit that recognizes a denomination being a kind of the banknote and a category being a classification based on a feature quantity of the banknote; a storage unit that stores the banknote inside thereof, and includes a memory that stores therein number-of-sheets information for the banknote stored in the storage unit by denomination and by category recognized by the recognizing unit; and a memory unit that stores therein number-of-sheets information for banknotes which are sorted and stored into each storage unit, by denomination and by category recognized by the recognizing unit.

In the banknote handling machine, the storage unit may include the memory that stores therein the number-of-sheets information by category, the category being classified into a first category as a genuine and fit note, a second category as a genuine and unfit note, a third category as a suspect note, a fourth category as a counterfeit note, and a fifth category as a rejected note, based on a combination of a first feature quantity indicating a shape of the banknote as an optical feature quantity obtained by optically measuring the banknote, a second feature quantity indicating an amount or a wavelength of transmissive light or reflected light through/by the banknote, and a third feature quantity indicating a magnetic content contained in the banknote as a magnetic feature quantity obtained by magnetically measuring the banknote.

In the banknote handling machine, the storage unit may include the memory that stores therein the number-of-sheets information by category, the category being classified into a first category as a genuine and fit note, a second category as a genuine and unfit note, a third category as a suspect note, a fourth category as a counterfeit note, and a fifth category as a rejected note, based on a combination of a first feature quantity indicating corner-fold or an amount of a missing part of the banknote as an optical feature quantity obtained by optically measuring the banknote, a second feature quantity indicating an attenuation of infrared rays of transmissive light or reflected light through/by the banknote, and a third feature quantity indicating a magnetic content contained in a serial-number printed portion, a portrait portion, and a denomination printed portion on the banknote, as a magnetic feature quantity obtained by magnetically measuring the banknote.

The banknote handling machine may further include a first updating unit that newly stores, when the storage unit is attached to the banknote handling machine, the number-of-sheets information stored in the memory of the storage unit by being associated with the storage unit, to thereby update the number-of-sheets information stored in the memory unit; a second updating unit that updates, when a banknote is fed into the storage unit or when a banknote is fed out of the storage unit, number-of-sheets information stored in the memory unit according to a banknote recognition result performed by the recognizing unit; and a third updating unit that overwrites, when the storage unit is removed from the banknote handling machine, the memory of the storage unit with the number-of-sheets information associated with the storage unit stored in the memory unit, to thereby update the number-of-sheets information stored in the memory.

In the banknote handling machine, a plurality of the storage units in which banknotes are stored by denomination may be formed in the banknote handling machine. The banknote handling machine may further include a first updating unit that newly stores, when the storage unit is attached to the banknote handling machine, the number-of-sheets information stored in the memory of the storage unit by being associated with the storage unit, to thereby update the number-of-sheets information stored in the memory unit, and that stores denomination information for identifying a single denomination stored in the storage unit associated with the storage unit, in the memory unit; a feed-in unit that selects, upon depositing of the banknote, a storage unit into which the banknote is to be fed according to a banknote recognition result by the recognizing unit and the denomination information stored in the memory unit, and that feeds the banknote into the selected storage unit; a feed-out unit that selects, upon dispensing of the banknote, a storage unit of which the banknote is fed out according to the denomination information stored in the memory unit, and that feeds out the banknote from the selected storage unit under a condition that a banknote recognition result of the fed-out banknote by the recognizing unit matches the denomination information; a second updating unit that updates, when a banknote is fed into the storage unit by the feed-in unit or when a banknote is fed out of the storage unit by the feed-out unit, number-of-sheets information stored in the memory unit according to a banknote recognition result by the recognizing unit; and a third updating unit that overwrites, when the storage unit is removed from the banknote handling machine, the memory unit of the storage unit with the number-of-sheets information stored in the memory unit associated with the storage unit, to thereby update the number-of-sheets information stored in the memory.

In the banknote handling machine, the storage unit may be formed with any one of or a plurality of storages among a depositing-money-temporary-holding storage that temporarily holds the banknote recognized by the recognizing unit upon depositing money, a temporary-dispensing-holding storage that temporarily holds the banknote recognized by the recognizing unit upon dispensing money, a mixed denomination storage that collectively stores therein the banknotes of mixed denominations, a depositing-suspect-note storage that stores therein the banknote determined as the third category by the recognizing unit upon depositing money, a depositing-counterfeit-note storage that stores therein the banknote determined as the fourth category by the recognizing unit upon depositing money, a dispensing-suspect-note storage that stores therein the banknote determined as the third category by the recognizing unit upon dispensing money, a dispensing-counterfeit-note storage that stores therein the banknote determined as the fourth category by the recognizing unit upon dispensing money, and a dispensing-rejected-note storage that stores therein the banknote determined as the fifth category by the recognizing unit upon dispensing money.

Effect of the Invention

According to the banknote storage, stored therein is number-of-sheets information for banknotes stored inside of the banknote storage by denomination being a kind of the banknotes and by category being a classification based on a feature quantity of the banknotes. Therefore, the number of banknotes stored in the storage unit can be determined by denomination and by category.

When accepting a write instruction of number-of-sheets information to the storage unit from an external device, the number-of-sheets information to the memory unit based on the write instruction is written, and when accepting a read instruction of number-of-sheets information of the memory unit from the external device, the number-of-sheets information from the memory unit based on the read instruction is read, and the read information to the external device is transmitted. Therefore, the number-of-sheets information stored in the storage unit can be updated by the external device, and the number-of-sheets information stored in the storage unit can be read by the external device Stored therein is the number-of-sheets information by category, the category being classified into a first category as a genuine and fit note, a second category as a genuine and unfit note, a third category as a suspect note, a fourth category as a counterfeit note, and a fifth category as a rejected note, based on a combination of a first feature quantity indicating a shape of the banknote as an optical feature quantity obtained by optically measuring the banknote, a second feature quantity indicating an amount or a wavelength of transmissive light or reflected light through/by the banknote, and a third feature quantity indicating a magnetic content contained in the banknote as a magnetic feature quantity obtained by magnetically measuring the banknote. Therefore, the number of banknotes stored in the storage unit can be determined by denomination and by definition due to European Central Bank (hereinafter, called "ECB").

The number-of-sheets information is stored by category, the category being classified into the first category as the genuine and fit note, the second category as the genuine and unfit note, the third category as the suspect note, the fourth category as the counterfeit note, and the fifth category as the rejected note, based on a combination of the first feature quantity indicating the corner-fold or the amount of the missing part of the banknote as the optical feature quantity obtained by optically measuring the banknote, the second feature quantity indicating the attenuation of infrared rays of transmissive light or reflected light through/by the banknote, and the third feature quantity indicating the magnetic content contained in the serial-number printed portion, the portrait portion, and the denomination printed portion on the banknote, as the magnetic feature quantity obtained by magnetically measuring the banknote. Therefore, it is possible to accurately determine the number of banknotes stored in the storage unit by denomination and by definition of ECB, and also add new trace information for identifying the user when the counterfeit note or the suspect note is taken-in, to the information.

According to the banknote handling machine, there is mounted the storage unit that stores banknotes inside thereof and includes the memory unit that stores therein the number-of-sheets information for the banknotes stored inside of the storage unit for each recognized denomination and for each recognized category thereof. Each denomination being a kind of the banknote and each category being a classification based on the feature quantities of the banknote are recognized, and the banknotes are sorted and stored into each storage unit. The each storage stores therein the number-of-sheets information for the banknotes stored in the each storage unit for each recognized denomination and for each recognized category. Therefore, it is possible to determine the number of banknotes stored in the storage by denomination and by category in both the storage and the banknote handling machine.

The storage includes a memory unit that stores therein the number-of-sheets information by category, the category being classified into a first category as a genuine and fit note, a second category as a genuine and unfit note, a third category as a suspect note, a fourth category as a counterfeit note, and a fifth category as a rejected note, based on a combination of a first feature quantity indicating a shape of the banknote as an optical feature quantity obtained by optically measuring the banknote, a second feature quantity indicating an amount or a wavelength of transmissive light or reflected light through/by the banknote, and a third feature quantity indicating a magnetic content contained in the banknote as a magnetic feature quantity obtained by magnetically measuring the banknote. Therefore, it is possible to determine the number of banknotes stored in the storage unit by denomination and by definition of ECB in both the storage unit and the banknote handling machine.

The storage unit includes the memory unit that stores therein the number-of-sheets information by category, the category being classified into a first category as a genuine and fit note, a second category as a genuine and unfit note, a third category as a suspect note, a fourth category as a counterfeit note, and a fifth category as a rejected note, based on a combination of a first feature quantity indicating corner-fold or an amount of a missing part of the banknote as an optical feature quantity obtained by optically measuring the banknote, a second feature quantity indicating an attenuation of infrared rays of transmissive light or reflected light through/by the banknote, and a third feature quantity indicating a magnetic content contained in a serial-number printed portion, a portrait portion, and a denomination printed portion on the banknote, as a magnetic feature quantity obtained by magnetically measuring the banknote. Therefore, it is possible to determine the number of banknotes stored in the storage unit by denomination and by definition of ECB in both the storage unit and the banknote handling machine, and also add new trace information for identifying the user when the counterfeit note or the suspect note is taken-in, to the information.

When a storage unit is attached to the banknote handling machine, the number-of-sheets information is updated by associating the number-of-sheets information stored in the memory of the memory unit. When a banknote is fed into the storage or when a banknote is fed out of the storage unit, the stored number-of-sheets information is updated according to a banknote recognition result. When a storage unit is removed from the banknote handling machine, the memory of the storage unit is overwritten with the stored number-of-sheets information associated with the storage unit, to thereby update the number-of-sheets information stored in the memory unit. By doing so, upon attachment of the storage unit, it is possible to accurately determine the number of banknotes stored in the storage unit by denomination and by category in both the storage unit including the attached storage and the banknote handling machine. Moreover, even after its removal, it is possible to accurately determine the number of banknotes stored in the removed storage unit by denomination and by category, and also accurately determine the number of banknotes stored in the storage units by denomination and by category in both the storage units and the banknote handling machine.

The storage is formed with a plurality of storage units in which banknotes are stored by denomination. When a storage unit is attached to the banknote handling machine, the number-of-sheets information is updated by associating the number-of-sheets information stored in the memory of the storage unit, and denomination information for identifying a single denomination stored in the storage unit is stored in association with the storage unit. Upon depositing of the banknote, a storage unit into which the banknote is to be fed is selected according to a banknote recognition result and the stored denomination information, and the banknote is fed into the selected storage unit. Upon dispensing of the banknote, a storage unit of which the banknote is fed out is selected according to the stored denomination information, and the banknote is fed out of the selected storage unit under the condition that the recognition result of the fed-out banknote matches the denomination information. Here, when a banknote is fed into the storage unit or when a banknote is fed out of the storage unit, the stored number-of-sheets information is updated according to the banknote recognition result. When a storage unit is removed from the banknote handling machine, the memory of the storage unit is overwritten with the stored number-of-sheets information associated with the storage unit, to thereby update the number-of-sheets information stored in the memory unit. By doing so, even if a storage unit that stores therein banknotes of a single denomination is mounted in any one of mounting locations, a taken-in banknote is stored in a storage unit that stores therein banknotes of the same denomination as that of the taken-in banknote without error upon depositing money, and a banknote can be dispensed without error from a storage unit that stores therein banknotes of the denomination required for a dispensed amount upon dispensing money.

The storage unit is formed with any one of or a plurality of storages, the storages being a depositing-money-temporary-holding storage that temporarily holds the banknote recognized by the recognizing unit upon depositing money, a temporary-dispensing-holding storage that temporarily holds the banknote recognized by the recognizing unit upon dispensing money, a mixed denomination storage that collectively stores therein the banknotes of mixed denominations, a depositing-suspect-note storage that stores therein the banknote determined as the third category by the recognizing unit upon depositing money, a depositing-counterfeit-note storage that stores therein the banknote determined as the fourth category by the recognizing unit upon depositing money, a dispensing-suspect-note storage that stores therein the banknote determined as the third category by the recognizing unit upon dispensing money, a dispensing-counterfeit-note storage that stores therein the banknote determined as the fourth category by the recognizing unit upon dispensing money, and a dispensing-rejected-note storage that stores therein the banknote determined as the fifth category by the recognizing unit upon dispensing money. Therefore, it is possible to determine the number of banknotes stored in the storage by denomination and by category in both the storages and the banknote handling machine.

BRIEF DESCRIPTION OF DRAWINGS

FIG. 7 is a diagram representing an example of information stored in a storage-management-table memory.

Figures 1, 2:
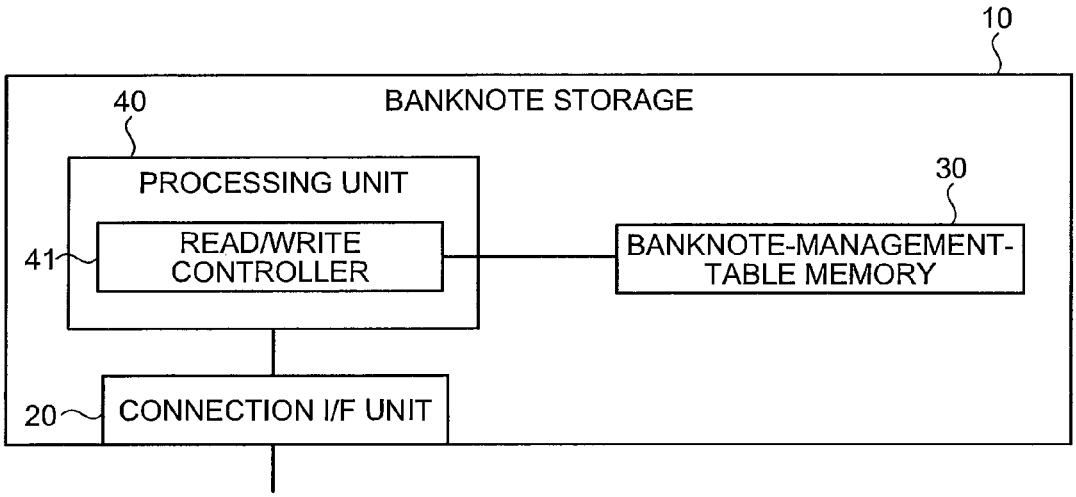
FIG. 1 is a diagram illustrating a configuration of a banknote storage according to a first embodiment.
FIG. 2 is a diagram representing an example of information stored in a banknote-management-table storage unit.

According to the invention as set forth in claim 9, the storage is formed with a plurality of storage units in which banknotes are stored by denomination. When a storage unit is attached to the banknote handling machine, the number-of-sheets information is updated by associating the number-of-sheets information stored in the memory of the storage unit, and denomination information for identifying a single denomination stored in the storage unit is stored in association with the storage unit. Upon depositing of the banknote, a storage unit into which the banknote is to be fed is selected according to a banknote recognition result and the stored denomination information, and the banknote is fed into the selected storage unit. Upon dispensing of the banknote, a storage unit of which the banknote is fed out is selected according to the stored denomination information, and the banknote is fed out of the selected storage unit under the condition that the recognition result of the fed-out banknote matches the denomination information. Here, when a banknote is fed into the storage unit or when a banknote is fed out of the storage unit, the stored number-of-sheets information is updated according to the banknote recognition result. When a storage unit is removed from the banknote handling machine, the memory of the storage unit is overwritten with the stored number-of-sheets information associated with the

EXPLANATIONS OF LETTERS OR NUMERALS

1 Memory board
2 Connector
10 Banknote storage
20 Connection I/F unit
30 Banknote-management-table memory
40 Processing unit
41 Read/write controller
50 Banknote handling machine
60 Upper unit
61 Inlet/outlet
62 Depositing/dispensing mechanism
63 Recognition/determination mechanism
64 Escrow unit
70 Lower unit
71 Collection storage
72*a* to 72*c* Storage
80 Transport path
90 Input unit
100*a* to 100*d* Connection I/F unit
110 Memory
111 Storage-management-table memory
120 Control unit
121 Stacked-banknote monitor
122 Transport controller
123 Recognition/determination mechanism controller
124 Banknote-storage removal controller
125 Banknote-storage attachment controller

BEST MODE(S) FOR CARRYING OUT THE INVENTION

Embodiments of the banknote storage and the banknote handling machine according to the present invention will be explained in detail below with reference to accompanying drawings. It should be noted that in the followings, the terms are explained, the configuration of the banknote storage according to a first embodiment is explained, effect of the first embodiment is explained, and then, a second embodiment and a third embodiment are explained.

First Embodiment

Explanation of Terms

First, the main terms used in the following embodiments are explained. A term of "feature quantity" represents numerical values or quantities obtained by measuring a banknote using a predetermined method. The present invention covers three feature quantities: a first feature quantity indicating a dog ear or a chipped amount of a banknote as an optical feature quantity obtained by optically measuring the banknote; a second feature quantity indicating an attenuation of infrared rays of transmissive light or reflected light through/by the banknote; and a third feature quantity indicating a magnetic content contained in a serial-number printed portion, a portrait portion, and a denomination printed portion on the banknote, as a magnetic feature quantity obtained by magnetically measuring the banknote.

A term of "category" represents classifications when banknotes are classified by their properties, and the present invention applies five classifications defined by ECB. More specifically, a banknote is largely classified into two depending on whether the banknote is authenticated as genuine or the banknote is anything other than the authenticated one within a range of the recognition capability of the banknote handling machine, and the former is called "genuine note" and the latter is called "rejected note". The genuine note is further classified into two depending on how the genuine note is damaged based on measurement thereof by the banknote handling machine, and one of them without any trouble in its usage is called "fit note" and the other one with any trouble assumed in its usage because of being largely damaged is called "unfit note". Consequently, the five classifications are composed of a "first category" as a genuine and fit note, a "second category" as a genuine and unfit note, a "third category" as a counterfeit note, a "fourth category" as a suspect note indicating that the banknote cannot be clearly determined as the genuine note by the banknote handling machine, and a "fifth category" as a rejected note determined by the banknote handling machine when two banknotes overlap each other upon recognition thereof or when the banknote is not placed properly on the recognition/determination unit. The banknote handling machine acquires the three feature quantities from the banknote and determines to which of the five classifications the banknote corresponds based on a combination of the three.

Configuration of Banknote Storage

The banknote storage according to the first embodiment is generally mounted on the banknote handling machine that manages depositing and dispensing of banknotes, and has main features in which it is possible to determine the number of banknotes stored inside the banknote storage by denomination and by category. The configuration of the banknote storage is explained below. FIG. 1 is a diagram illustrating the configuration of the banknote storage according to the first embodiment. As shown in FIG. 1, a banknote storage 10 includes a connection I/F unit 20, a banknote-management-table memory 30, and a processing unit 40.

The connection I/F unit 20 is physically connected with an external device, to allow mutual communications. More specifically, when receiving a write instruction or a read instruction from the external device, the connection I/F unit 20 outputs the content related to the instruction to a read/write controller 41. Furthermore, the connection I/F unit 20 receives number-of-sheets information that the read/write controller 41 reads from the banknote-management-table memory 30 based on the read instruction, and transmits the received number-of-sheets information to the external device. The external device represents a computer (e.g., a handy terminal and a desktop computer) that can write and read the number-of-sheets information to and from the banknote-management-table memory 30 as well as the banknote handling machine mounted with the banknote storage 10.

The banknote-management-table storage unit 30 stores therein the number-of-sheets information for banknotes stored inside of the banknote storage 10 by denomination being a kind of the banknotes and by category being a classification based on the feature quantities of the banknotes.

More specifically, as shown in FIG. 2, the banknote-management-table memory 30 stores the number-of-sheets information in each cell of a matrix table in which rows are classified by each denomination information indicating each denomination of banknotes and columns are classified by each classification information indicating each classification of the categories. For example, as shown in FIG. 2, the banknote-management-table memory 30 stores "20" as the number-of-sheets information in a cell, of the matrix table, determined by "1000 yen" as the denomination information and "first category" as the classification information. In other words, the information indicates that "20" banknotes each of which denomination is "1000 yen" and classification is "first category" are stored in the banknote storage 10.

The processing unit 40 is a processor that includes an internal memory that stores therein programs and control data defining various procedures and thereby executes various processes. The control unit 40 includes the read/write controller 41, which is particularly closely related to the present invention. It should be noted that the read/write controller 41 may be referred to as "communication unit".

When accepting a write instruction of the number-of-sheets information to the banknote-management-table memory 30 from the external device, the read/write controller 41 writes the number-of-sheets information to the banknote-management-table memory 30 based on the write instruction. When accepting a read instruction of the number-of-sheets information to the banknote-management-table memory 30 from the external device, the read/write controller 41 reads the number-of-sheets information from the banknote-management-table memory 30 based on the read instruction, and transmits the read information to the external device.

Explanation is made by using a specific example. The read/write controller 41 receives the number-of-sheets information (receives, for example, "1000 yen" as the denomination information, "first category" as the classification information, and "20" as the number-of-sheets information) for a specified cell of the matrix table stored in the banknote-management-table memory 30, from the banknote handling machine mounted with the banknote storage 10 through the connection I/F unit 20, and updates the number-of-sheets information stored in the specified cell to the received number-of-sheets information.

The read/write controller 41 is connected to the connection I/F unit 20. When receiving the read instruction of the number-of-sheets information (for example, "1000 yen" as the denomination information and "first category" as the classification information) to a specified cell of the matrix table stored in the banknote-management-table memory 30, from the banknote handling machine mounted with the banknote storage 10 through the connection I/F unit 20, the read/write controller 41 reads the number-of-sheets information stored in the specified cell (for example, the number-of-sheets information "20") and transmits the read information to the banknote storage 10 through the connection I/F unit 20. Specification of the write or the read is not limited to one cell, and, for example, a plurality of cells may also be specified.

Overview of Banknote Storage

Figure 3:
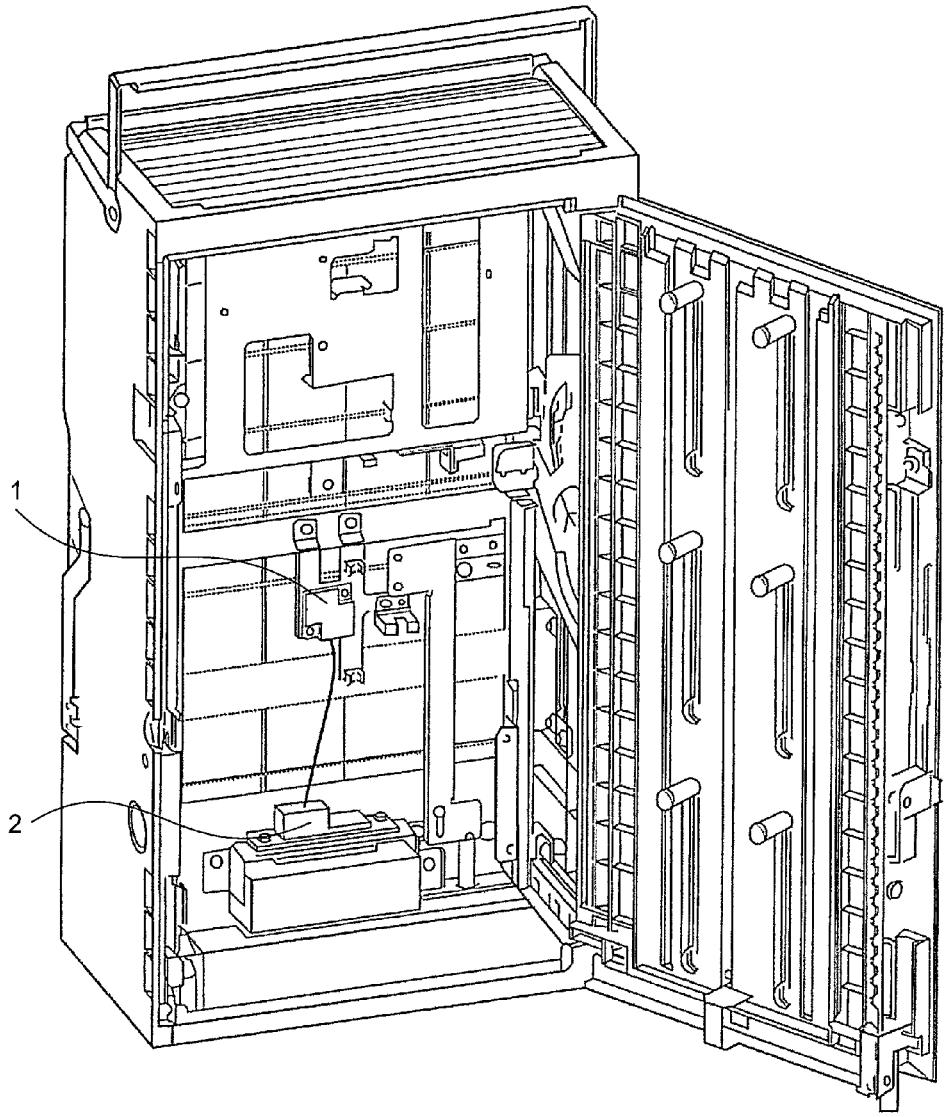
FIG. 3 is a schematic representing an overview of the banknote storage.

Next, the overview of the banknote storage according to the first embodiment is explained below with reference to FIG. 3 and FIG. 4. FIG. 3 is a schematic representing the overview of the banknote storage, and FIG. 4 is a three-side view of the banknote storage.

Figure 4:
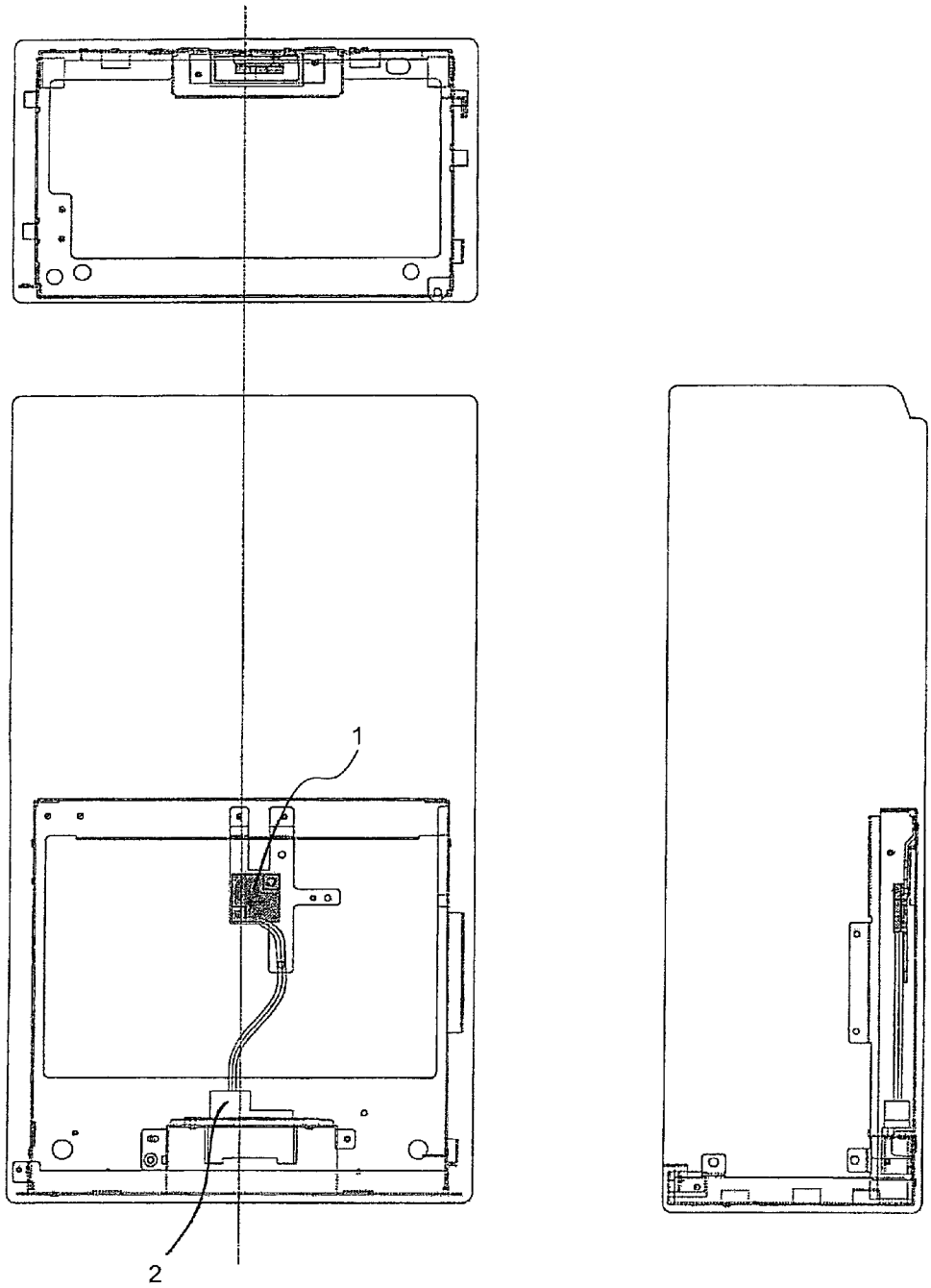
FIG. 4 is a three-side view of the banknote storage.

As shown in FIG. 3 and FIG. 4, the banknote storage 10 includes a memory board 1 corresponding to the banknote-management-table memory 30, and stores the number-of-sheets information in the memory board 1. The banknote storage 10 also includes a connector 2 corresponding to the connection I/F unit 20, and the connector 2 is physically connected to the external device such as the banknote handling machine, which allows mutual communications.

Effect of First Embodiment

As explained above, according to the first embodiment, the number-of-sheets information for banknotes stored inside the banknote storage is stored by denomination being the kind of the banknotes and by category being the classification based on the feature quantities of the banknotes, which enables the number of banknotes stored inside thereof to be determined by denomination and by category. As a result, when the counterfeit note or the suspect note is taken-in, new trace information for identifying the user can also be added to the information.

Furthermore, according to the first embodiment, when the write instruction of the number-of-sheets information to the banknote-management-table memory is accepted from the external device, the number-of-sheets information is written to the banknote-management-table memory based on the write instruction. When the read instruction of the number-of-sheets information to the banknote-management-table memory is accepted from the external device, the number-of-sheets information is read from the banknote-management-table memory based on the read instruction, and the read information is transmitted to the external device. Therefore, the number-of-sheets information stored in the banknote storage can be updated by the external device, and the number-of-sheets information stored in the banknote storage can be read by the external device.

Second Embodiment

The second embodiment explains the banknote handling machine mounted with the banknote storage according to the first embodiment. It should be noted that a banknote storage mounted on the banknote handling machine according to the second embodiment can be removably attached to the banknote handling machine. Furthermore, in the banknote handling machine according to the second embodiment, a denomination to be stored in a banknote storage provided in a mounting location is preset for each mounting location.

Overview and Features of Banknote Handling Machine

Figure 5:
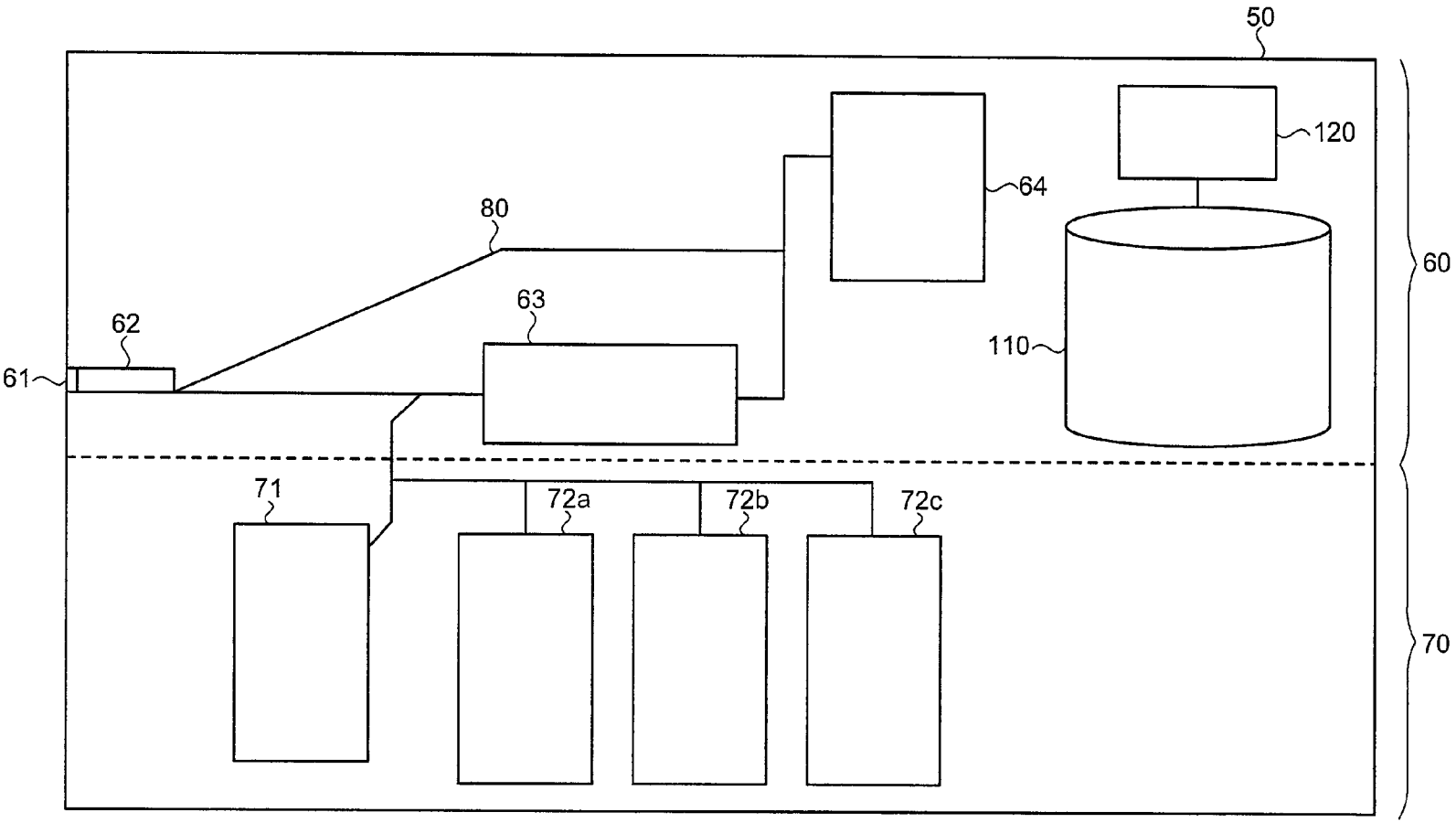
FIG. 5 is a diagram for explaining an overview and features of a banknote handling machine according to a second embodiment.

The overview and features of the banknote handling machine according to the second embodiment are explained below with reference to FIG. 5. FIG. 5 is a diagram for explaining the overview and the features of the banknote handling machine according to the second embodiment. As shown in this figure, a banknote handling machine 50 includes an upper unit 60 and a lower unit 70. The upper unit 60 includes an inlet/outlet 61, a depositing/dispensing mechanism 62, a recognition/determination mechanism 63, and an escrow unit 64, and the lower unit 70 includes a collection storage 71 and storages 72*a* to 72*c*, which communicate each other through a transport path 80. The banknote handling machine 50 mainly manages depositing and dispensing of banknotes, and has main features in which both the storages and the banknote handling machine can determine the number of banknotes stored in each storage by denomination and by category.

More specifically, as shown in FIG. 5, the recognition/determination mechanism 63 recognizes each denomination being a kind of the banknote and each category being a classification based on the feature quantities of the banknote. The collection storage 71 and the storages 72*a* to 72*c* store therein banknotes and store therein number-of-sheets information for the banknotes stored inside thereof by denomination and by category recognized by the recognition/determination mechanism 63. Furthermore, the memory 110 divides the inside thereof for each storage, and stores therein the number-of-sheets information for the banknotes stored in each storage by denomination and by category recognized by the recognition/determination mechanism 63.

By doing so, as the main features, the banknote handling machine according to the second embodiment enables both the storages and the banknote handling machine to determine the number of banknotes stored in each storage by denomination and by category.

Configuration of Banknote Handling Machine

Figure 6:
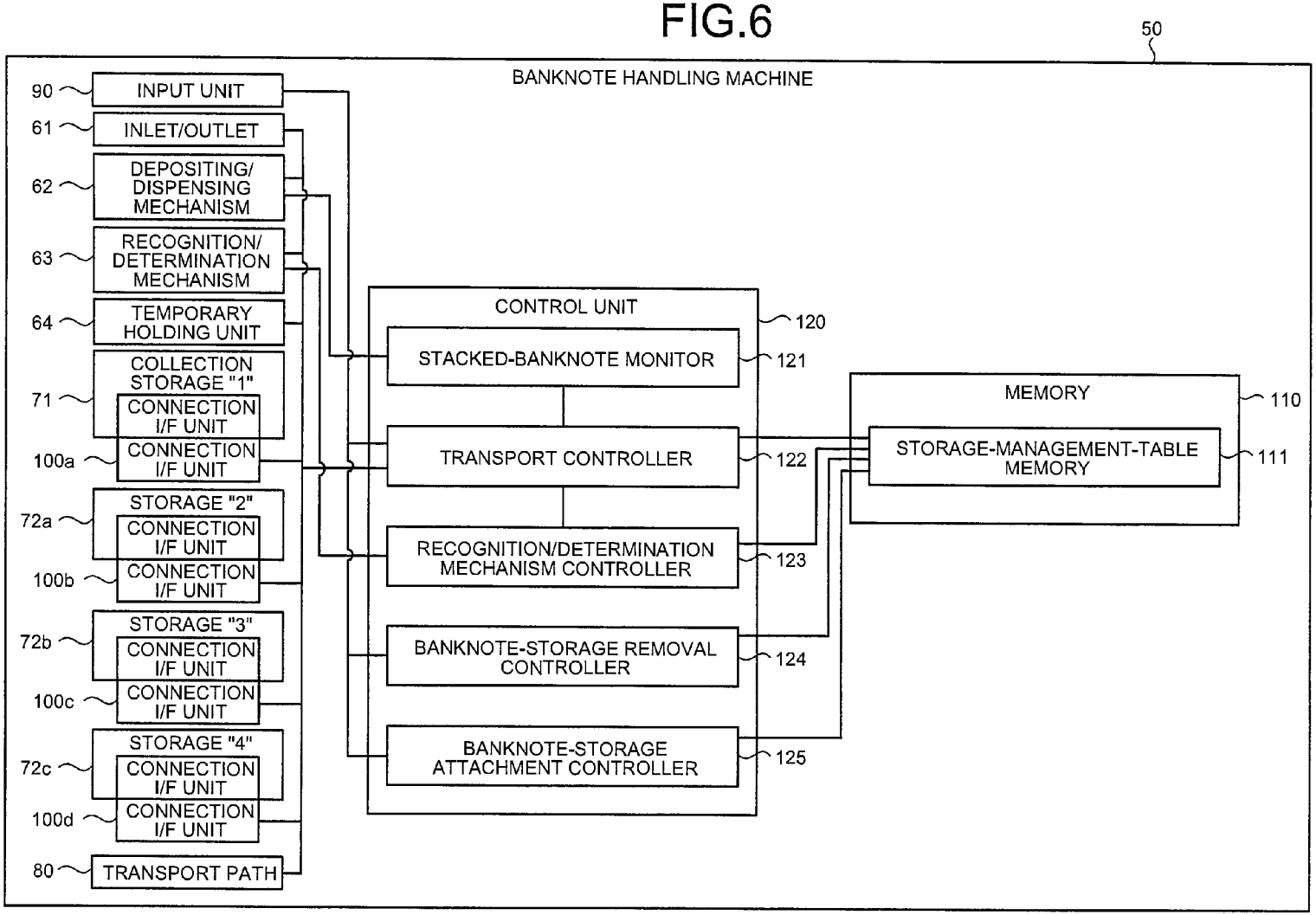
FIG. 6 is a diagram for explaining a configuration of the banknote handling machine according to the second embodiment.

Next, the configuration of the banknote handling machine 50 is explained with reference to FIG. 6. FIG. 6 is a block diagram illustrating the configuration of the banknote handling machine 50. As shown in this figure, the banknote handling machine 50 includes the inlet/outlet 61, the depositing/dispensing mechanism 62, the recognition/determination mechanism 63, the escrow unit 64, the collection storage 71, the storages 72*a* to 72*c*, the transport path 80, an input unit 90, connection I/F units 100*a* to 100*d* for physical connection of the banknote storages, the memory 110, and the control unit 120.

Here, the collection storage 71 and the storages 72*a* to 72*c* can be removably attached to the banknote handling machine 50. The banknote handling machine 50 is preset so that even if the collection storage 71 and the storages 72*a* to 72*c* are replaced with other storages, a storage for storing therein banknotes for all the denominations is assumed to be mounted in the mounting location where the collection storage 71 is currently mounted, and storages for storing therein 1000-yen notes, 5000-yen notes, and 10000-yen notes respectively are assumed to be mounted in the mounting locations where the storages 72*a* to 72*c* are currently mounted.

Similarly to the banknote storage 10 according to the first embodiment, each of the storages 72*a* to 72*c* stores therein banknotes, and includes a memory that stores therein number-of-sheets information for the banknotes stored inside of each of the storages by denomination and by category recognized by the recognition/determination mechanism 63. More specifically, the storage 72*a* stores therein 1000-yen notes, the storage 72*b* stores therein 5000-yen notes, and the storage 72*c* stores therein 10000-yen notes. Upon dispensing money, corresponding banknotes are fed into the transport path 80 under control by the control unit 120. Assigned to each of the storages 72*a* to 72*c* is storage identification information so as to enable the storages to be uniquely identified (for example, storage identification information "2" is assigned to the storage 72*a*).

The transport path 80 transports the banknotes from the components to the components inside the banknote handling machine 50. More specifically, upon dispensing money, the transport path 80 transports the banknotes fed out of the storages 72*a* to 72*c* to the recognition/determination mechanism 63 under control by the control unit 120, and transports the banknotes determined as the genuine and fit note by the recognition/determination mechanism 63, only for a dispensed amount, finally to the inside of the depositing/dispensing mechanism 62. The banknote determined as anything other than the genuine and fit note is transported to the escrow unit 64, is again determined by the recognition/determination mechanism 63, and is transported to any one of the storages 72*a* to 72*c* based on the result of determination. At this time, when the banknote determined by the recognition/determination mechanism 63 is the rejected note or when any one of the storages 72*a* to 72*c* being a corresponding destination is detected as being full, then the banknote is transported to the collection storage 71. Furthermore, upon depositing money, the transport path 80 transports the banknote fed out of the depositing/dispensing mechanism 62 to the recognition/determination mechanism 63 or to the escrow unit 64 under control by the control unit 120, and the banknote determined by the recognition/determination mechanism 63 as anything other than the rejected note is finally transported to any one of the storages 72*a* to 72*c* and to the collection storage 71 as a result of determination by the recognition/determination mechanism 63 and according to each amount of storage capacity of the storages 72*a* to 72*c*.

The recognition/determination mechanism 63 recognizes each denomination being a kind of the banknote and each category being a classification based on the feature quantities of the banknote. More specifically, when receiving a banknote, the recognition/determination mechanism 63 conducts predetermined measurement to the banknote to acquire feature quantities of the banknote under control by the control unit 120, and recognizes the banknote based on the feature quantities.

The escrow unit 64 temporarily stacks therein the banknotes transported thereto based on the result of recognition by the recognition/determination mechanism 63, and the collection storage 71 stores therein the banknotes transported from the escrow unit 64. The depositing/dispensing mechanism 62 holds therein the received banknotes upon dispensing money, and feeds the banknote stored therein into the transport path 80 upon depositing money. The inlet/outlet 61 is provided with an openable and closable shutter, and opens and closes the shutter under control by the control unit 120. Opening of the shutter allows the user to take out the banknotes stacked in the depositing/dispensing mechanism 62 and to put the banknote inside the depositing/dispensing mechanism 62.

The input unit 90 is formed with a touch panel or the like provided on the outer surface of the machine, and accepts a request related to dispensing/depositing money and inputs the request to the control unit 120. More specifically, when accepting a specified dispensed amount by pressing a specified position of the touch panel by the user, the input unit 90 outputs information for the dispensed amount to a transport controller 122, explained later. For example, when accepting a dispensed amount of 36000 yen, the input unit 90 outputs information "36000" as the dispensed amount to the transport controller 122. Furthermore, when accepting an instruction to start a depositing process by pressing a specified position of the touch panel by the user, the input unit 90 outputs the signal instructing a start of the depositing process to the transport controller 122. In addition, the input unit 90 can also accept a request related to attachment and removal of the storage from the manager and input the request to a banknote-storage removal controller 124 and to a banknote-storage attachment controller 125, which are explained later.

The memory 110 stores therein data used for various processes performed by the control unit 120, and includes a storage-management-table memory 111, which is particularly closely related to the present invention.

The storage-management-table memory 111 divides a table into those for the storages, and stores therein number-of-sheets information for the banknotes stored in the storages by denomination and by category recognized by the recognition/determination mechanism 63. More specifically, as shown in FIG. 7, the storage-management-table memory 111 stores therein mounting-location identification information for uniquely identifying a mounting location where a relevant storage is mounted, storage identification information, and stored-denomination information indicating a denomination of a banknote to be stored in the storage to which the storage identification information is assigned, in association with each other for each banknote storage. Furthermore, the storage-management-table memory 111 stores the number-of-sheets information for banknotes stored in the banknote storage by denomination and by category in a matrix table for each banknote storage. For example, as shown in FIG. 7, the storage-management-table memory 111 stores the stored-denomination information "1000 yen" associated with mounting-location identification information "B" in the storage identification information "2". In addition, the storage-management-table memory 111 stores the number-of-sheets information "100", for the banknotes stored in the storage with the storage identification information "2" assigned thereto, in the cell determined by the denomination information "1000 yen" and the classification information "first category".

The control unit 120 is a processor that includes an internal memory that stores therein programs and control data defining various procedures and thereby executes various processes. The control unit 120 includes a stacked-banknote monitor 121, the transport controller 122, a recognition/determination mechanism controller 123, the banknote-storage removal controller 124, and the banknote-storage attachment controller 125, which are particularly closely related to the present invention. In addition, the banknote-storage removal controller 124 corresponds to "recognizing unit" and "third updating unit" according to the claims, similarly to the above, the recognition/determination mechanism controller 123 corresponds to "second updating unit", and also similarly to the above, the banknote-storage attachment controller 125 corresponds to "first updating unit".

The stacked-banknote monitor 121 monitors inside of the depositing/dispensing mechanism 62, and calculates an amount of money of stacked banknotes. More specifically, upon dispensing money, when a last banknote is stacked inside of the depositing/dispensing mechanism 62, the stacked-banknote monitor 121 calculates a total amount of money and outputs information indicating the calculated total amount of money to the transport controller 122.

The transport controller 122 controls relevant components so that the banknote travels along a specified route when it is deposited or dispensed. More specifically, when receiving information for a dispensed amount from the input unit 90, the transport controller 122 instructs the recognition/determination mechanism controller 123 so as to update the number-of-sheets information and calculates denominations and number-of-sheets information for banknotes to be fed (for example, if dispensed-amount information is "36000", this includes three 10000-yen notes, one 5000-yen note, and one 1000-yen note). The transport controller 122 recognizes the denomination of a banknote to be stored in the storage by referring to the storage-management-table memory 111, and controls the storages 72*a* to 72*c* so as to feed the number of banknotes based on the dispensed amount into the transport path 80 (for example, the control is provided so that the storage 72*a* feeds one 1000-yen note, the storage 72*b* feeds one 5000-yen note, and the storage 72*c* feeds three 10000-yen notes). The transport controller 122 controls the transport path 80, and outputs a signal indicating a start of controlling the recognition/determination mechanism 63 to the recognition/determination mechanism controller 123, explained later.

When receiving the result of determination indicating that the banknote is the genuine and fit note from the recognition/determination mechanism controller 123, the transport controller 122 controls the transport path 80 to transport the banknote to the inside of the depositing/dispensing mechanism 62. Meanwhile, when receiving the result of determination indicating that the banknote is anything other than the genuine and fit note from the recognition/determination mechanism controller 123, the transport controller 122 controls the transport path 80 to transport the banknote to the escrow unit 64. When receiving the information for the total amount of money of the banknotes currently stacked inside the depositing/dispensing mechanism 62 from the stacked-banknote monitor 121, the transport controller 122 checks the received information against the information for the dispensed amount received from the input unit 90. If both the amounts match each other, the transport controller 122 controls the inlet/outlet 61 so as to open the shutter. Meanwhile, when the banknote determined as anything other than the genuine and fit note is transported to the escrow unit 64, the transport controller 122 controls the escrow unit 64 so as to feed the banknotes held inside thereof into the transport path 80. When the banknote again determined by the recognition/determination mechanism 63 is the rejected note or when any one of the storages 72*a* to 72*c* being a corresponding destination is detected as being full, then the transport controller 122 controls the transport path 80 to transport the banknote to the collection storage 71. If both the amounts are different from each other as a result of checking, the transport controller 122 also controls relevant components so as to transport the banknote for an insufficient amount of money to the inside of the depositing/dispensing mechanism 62.

When receiving the signal instructing the start of the depositing process from the input unit 90, the transport controller 122 instructs the recognition/determination mechanism controller 123 so as to update the number-of-sheets information, and controls the depositing/dispensing mechanism 62 to feed the banknote put inside thereof by the user into the transport path 80. The transport controller 122 outputs a signal instructing a start of controlling the recognition/determination mechanism 63 to the recognition/determination mechanism controller 123.

When receiving the result of determination indicating that the banknote is the rejected note from the recognition/determination mechanism controller 123, the transport controller 122 controls the transport path 80 to transport the banknote to the inside of the depositing/dispensing mechanism 62. Meanwhile, when receiving the result of determination indicating that the banknote is anything other than the rejected note from the recognition/determination mechanism controller 123, the transport controller 122 controls the transport path 80 to transport the banknote to the escrow unit 64. The transport controller 122 controls the depositing/dispensing mechanism 62 so as to feed the last banknote put inside thereof into the transport path 80, and then, after a predetermined time passes, controls the inlet/outlet 61 so as to open the shutter, and controls the input unit 90 so as to display information for the deposited amount of money and its receipt on the touch panel in order to allow the user to confirm them. When receiving a signal indicating confirmation of the depositing money through the input unit 90, the transport controller 122 controls the escrow unit 64 so as to feed the banknotes stacked inside thereof into the transport path 80, and the banknotes are again determined by the recognition/determination mechanism 63 and are transported to the storages 72*a* to 72*c* according to the result of determination. At this time, when the banknote determined by the recognition/determination mechanism 63 is the rejected note or when any one of the storages 72*a* to 72*c* being a corresponding destination is detected as being full, then the banknote is transported to the collection storage 71.

The recognition/determination mechanism controller 123 recognizes each denomination being a kind of banknotes and each category being a classification based on the feature quantities of the banknotes. In addition, when the banknote is fed into each storage or when the banknote is fed out of each storage, the recognition/determination mechanism controller 123 updates the number-of-sheets information stored in the storage-management-table memory 111 according to the result of recognition of the banknote performed by the recognition/determination mechanism 63.

More specifically, when receiving the signal instructing the start of controlling the recognition/determination mechanism 63 from the transport controller 122, the recognition/determination mechanism controller 123 controls the recognition/determination mechanism 63 to acquire the three feature quantities from the banknote currently transported to the recognition/determination mechanism 63. More specifically, the recognition/determination mechanism controller 123 controls the recognition/determination mechanism 63 to optically measure the banknote and thereby acquire the first feature quantity indicating corner-fold or an amount of a missing part of the banknote, controls the recognition/determination mechanism 63 to irradiate the banknote with infrared rays and thereby acquire the second feature quantity indicating an attenuation of the infrared rays of transmissive light or reflected light through/by the banknote, and controls the recognition/determination mechanism 63 to magnetically measure the banknote and thereby acquire the third feature quantity indicating a magnetic content contained in a serial-number printed portion, a portrait portion, and a denomination printed portion on the banknote. The recognition/determination mechanism controller 123 determines to which classification of the five classifications the banknote corresponds based on the combination of these to acquire the classification information, and outputs the result of determination to the transport controller 122. Moreover, the recognition/determination mechanism controller 123 controls the recognition/determination mechanism 63 to determine the denomination of the banknote, to acquire the denomination information, and updates the number-of-sheets information stored in the storage-management-table memory 111 based on the instruction related to calculation by the transport controller 122.

For example, if the classification information is "first category" indicating the genuine and fit note and the denomination information is "1000 yen" as a result of determination upon dispensing money, the recognition/determination mechanism controller 123 updates the number-of-sheets information "100" stored in a corresponding cell of the matrix table (a corresponding cell associated with the storage identification information "2" in FIG. 7) stored in the storage-management-table memory 111 to "99". If the classification information is "fifth category" indicating the rejected note and the denomination information is "5000 yen" as a result of determination upon dispensing money, the recognition/determination mechanism controller 123 updates the number-of-sheets information "100" stored in a corresponding cell of the matrix table (a corresponding cell associated with the storage identification information "3" in FIG. 7) stored in the storage-management-table memory 111 to "99", and finally stores the rejected note in the collection storage 71. Therefore, the recognition/determination mechanism controller 123 updates "0" as the number-of-sheets information, for the banknote stored in the collection storage 71, stored in the cell determined by the classification information "rejected note" and the denomination information "5000 yen", to "1".

Meanwhile, if the genuine note of 1000 yen, for example, is finally stored in the storage 72*a* as a result of determination upon depositing money and thus the classification information is the "first category" indicating the genuine and fit note, and if the denomination information is "1000 yen", the recognition/determination mechanism controller 123 updates the number-of-sheets information "100" for the banknote stored in the collection storage 71 in the cell (a corresponding cell associated with the storage identification information "2" in FIG. 7) determined by the classification information "first information" and the denomination information "1000 yen", to "101".

When a currently mounted specified storage is removed from the banknote handling machine 50, the banknote-storage removal controller 124 overwrites the memory of the storage with the number-of-sheets information stored in the storage-management-table memory 111 in association with the storage, to thereby update the number-of-sheets information stored in the memory.

Explanation is made by using a specific example. When accepting a removal request of the storage 72*a* from the input unit 90, the banknote-storage removal controller 124 reads the number-of-sheets information stored in each cell of the matrix table associated with the storage identification information "2" for the storage 72*a* which is specified to be removed, together with the classification information and the denomination information which determine the cell in the storage-management-table memory 111, and transmits the read information to the storage 72*a* (for example, transmits the classification information "first category", the denomination information "1000 yen", and the number-of-sheets information "100"). When transmission for all the cells of the matrix table is finished, the banknote-storage removal controller 124 unlocks a connection portion to which the storage 72*a* is connected at the mounting location. It should be noted that in the storage-management-table memory 111, the number-of-sheets information stored in all the cells of the matrix table in the memory of the storage as the object to be removed becomes "0" as a default value. In addition, there is no need to accept the removal request from the input unit 90, and it is therefore possible to control the banknote-storage removal controller 124 so as to perform the processes required for the removal in conjunction with, for example, a removal button.

When a specified storage is attached to the banknote handling machine 50, the banknote-storage attachment controller 125 newly stores the number-of-sheets information stored in the memory of the storage associated with the storage in the storage-management-table memory 111, to thereby update the number-of-sheets information stored in the storage-management-table memory 111.

Explanation is made by using a specific example. When a specified storage is connected to a mounting location (mounting-location identification information "B") where the storage for storing therein 1000-yen notes is mounted and a read instruction of the number-of-sheets information stored in the storage is accepted from the input unit 90, the banknote-storage attachment controller 125 instructs the storage to transmit storage identification information. When receiving the storage identification information "5" from the storage, the banknote-storage attachment controller 125 updates the storage identification information associated with the mounting-location identification information "B", from "2" to "5". Next, the banknote-storage attachment controller 125 specifies the cell by the classification information "first category" and the denomination information "1000 yen", and instructs the storage to transmit the number-of-sheets information stored in the specified cell thereto. When receiving the number-of-sheets information "100", the banknote-storage attachment controller 125 updates the number-of-sheets information stored in the cell determined by the classification information "first category" and the denomination information "1000 yen" of the matrix table associated with the storage identification information "5" from "0 (default value)" to "100" in the storage-management-table memory 111. Thereafter, the banknote-storage attachment controller 125 receives the number-of-sheets information for all the cells in the matrix table. Moreover, after finishing the update of the received number-of-sheets information, it is also possible to display the information (for example, a message of "completion of attachment") indicating completion of an attachment process on the touch panel of the input unit 90.

Processes of Banknote Handling Machine

Figure 8:
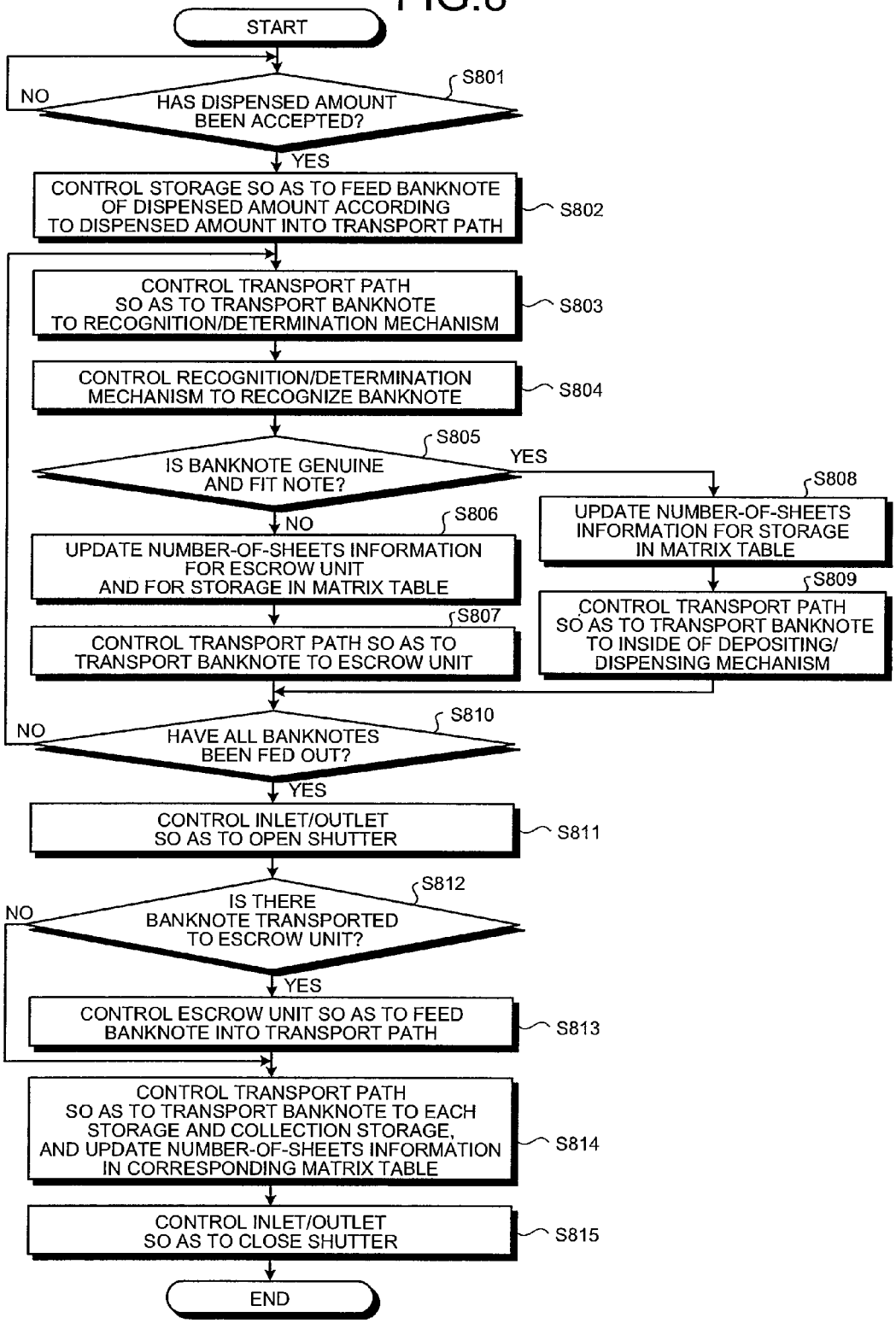
FIG. 8 is a flowchart representing a process flow upon dispensed-money of money in the banknote handling machine.
Figure 9:
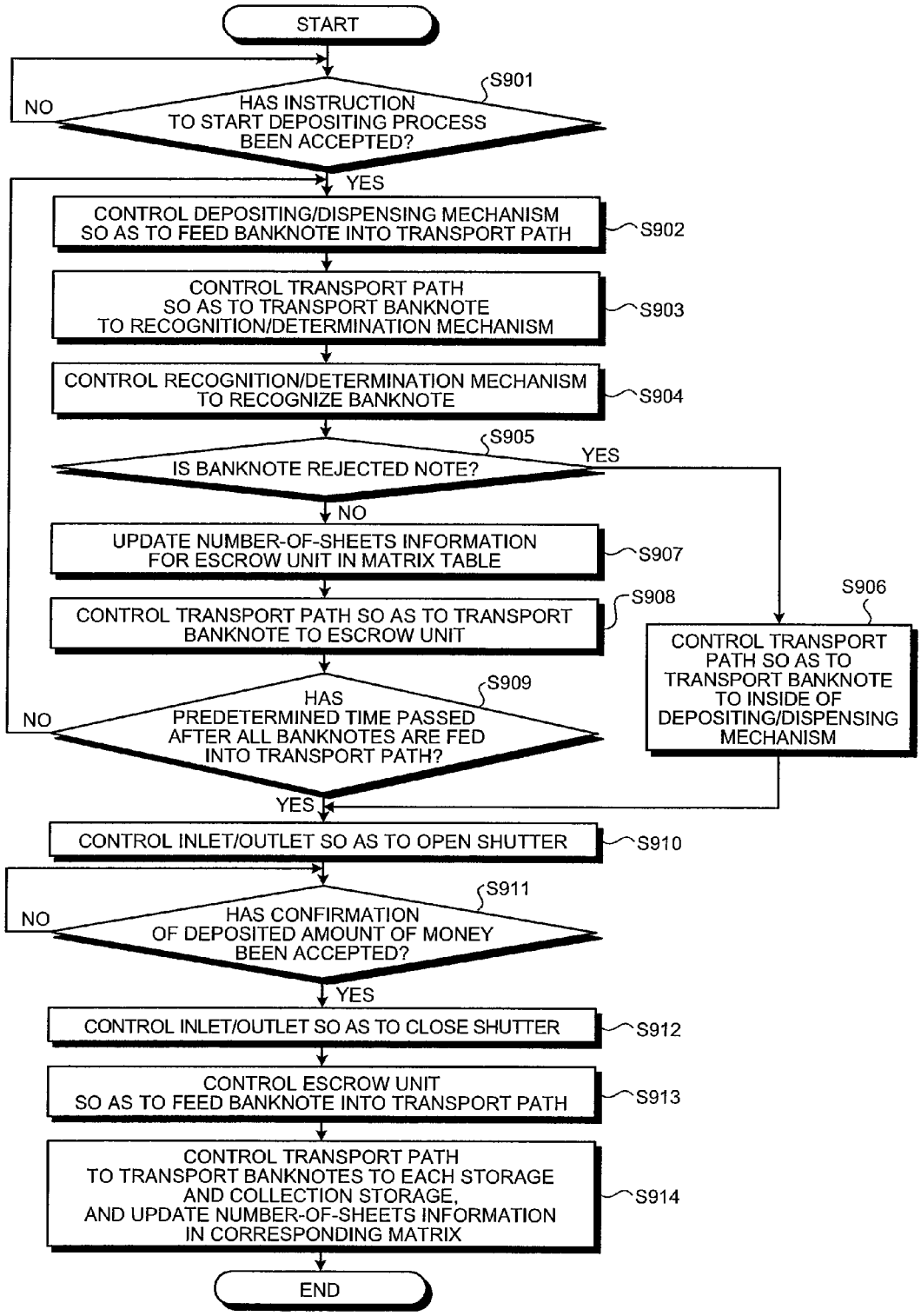
FIG. 9 is a flowchart representing a process flow upon reception of money in the banknote handling machine.
Figure 10:
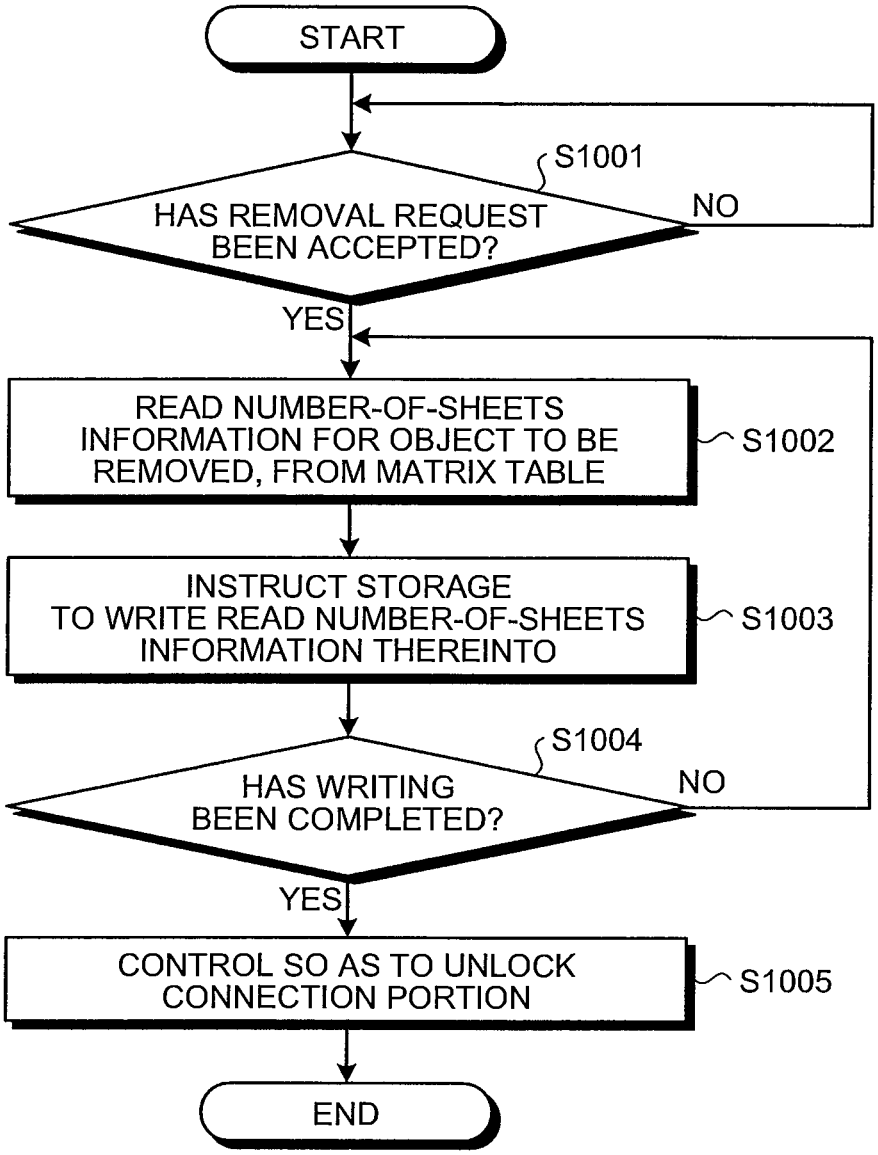
FIG. 10 is a flowchart representing a process flow in the banknote handling machine when the banknote storage is removed therefrom.
Figure 11:
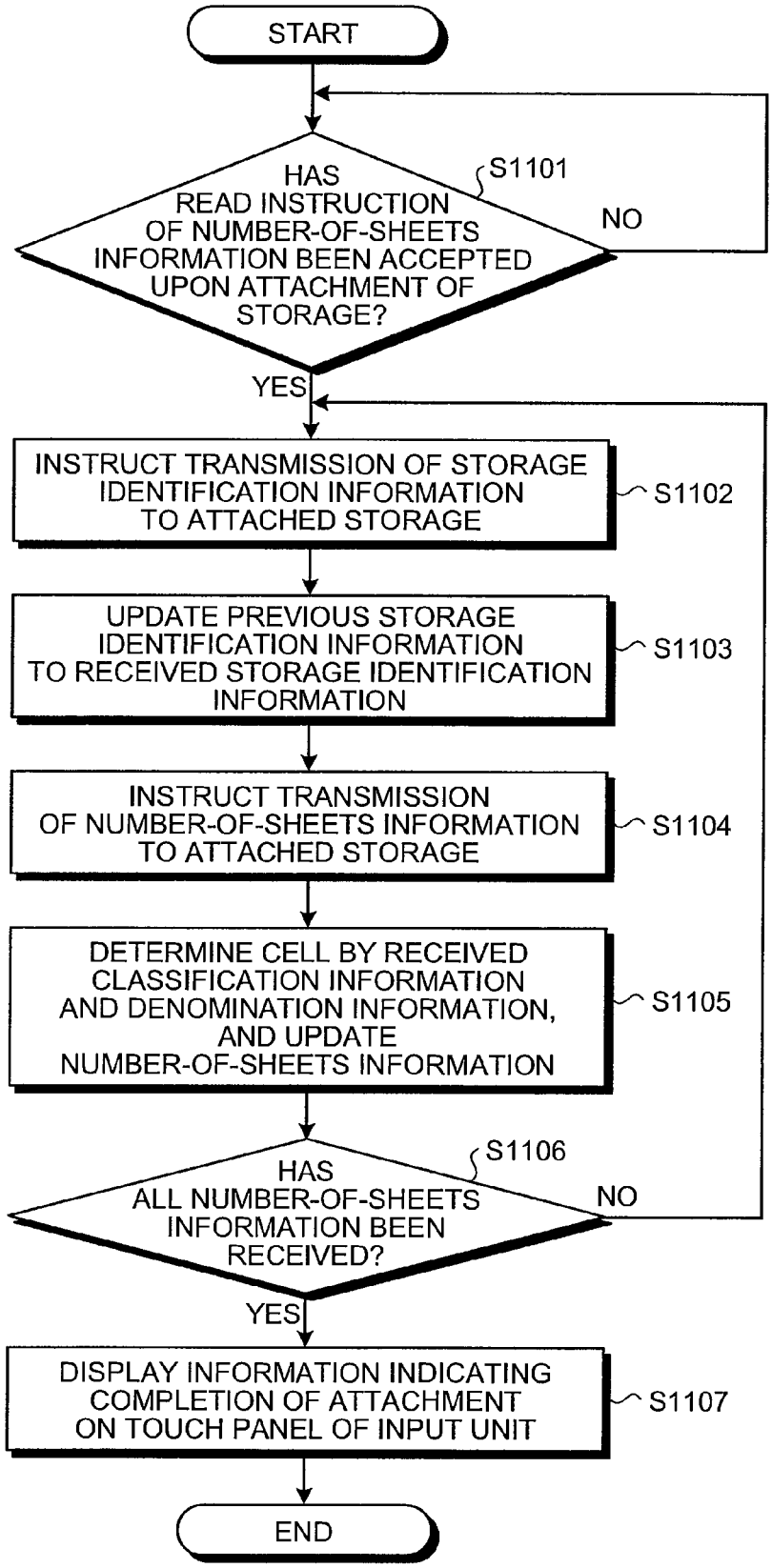
FIG. 11 is a flowchart representing a process flow in the banknote handling machine when the banknote storage is attached thereto.

Next, the processes of the banknote handling machine 50 are explained with reference to FIG. 8, FIG. 9, FIG. 10, and FIG. 11. FIG. 8 is a flowchart representing a process flow upon dispensing money in the banknote handling machine, FIG. 9 is a flowchart representing a process flow upon depositing money in the banknote handling machine, FIG. 10 is a flowchart representing a process flow in the banknote handling machine when the banknote storage is removed therefrom, and FIG. 11 is a flowchart representing a process flow in the banknote handling machine when the banknote storage is attached thereto.

Process Upon Dispensing Money in Banknote Handling Machine

As shown in FIG. 8, when accepting a specified dispensed amount from the user through the input unit 90 (YES at Step S801), the banknote handling machine 50 causes the transport controller 122 to control the storages 72*a* to 72*c* so as to feed the banknote for the dispensed amount into the transport path 80 (Step S802). The banknote handling machine 50 causes the transport controller 122 to control the transport path 80 so as to transport the banknote to the recognition/determination mechanism 63 (Step S803).

The banknote handling machine 50 causes the recognition/determination mechanism controller 123 to control the recognition/determination mechanism 63 to recognize the banknote (Step S804). If the banknote is the genuine and fit note (YES at Step S805), the banknote handling machine 50 reduces and updates the number-of-sheets information stored in the cell of the matrix table stored in the storage-management-table memory 111 (Step S808). The banknote handling machine 50 causes the transport controller 122 to control the transport path 80 so as to transport the banknote to the inside of the depositing/dispensing mechanism 62 (Step S809). Meanwhile, if the banknote is anything other than the genuine and fit note as a result of recognition (NO at Step S805), the banknote handling machine 50 updates the number-of-sheets information stored in the cell of the matrix table stored in the storage-management-table memory 111 (Step S806). The banknote handling machine 50 causes the transport controller 122 to control the transport path 80 so as to transport the banknote to the escrow unit 64 (Step S807).

When banknotes for the dispensed amount are stacked in the depositing/dispensing mechanism 62 or when, as a result of checking by the transport controller 122 (as a result of checking information for a total amount of money output from the stacked-banknote monitor 121 to the transport controller 122 against information for the dispensed amount output from the input unit 90 to the transport controller 122), both the pieces of information match each other (YES at Step S810), the banknote handling machine 50 causes the transport controller 122 to control the inlet/outlet 61 so as to open the shutter (Step S811). Here, if there are banknotes transported to the escrow unit (YES at Step S812), the banknote handling machine 50 causes the transport controller 122 to control the escrow unit 64 so as to feed the banknotes held inside thereof into the transport path 80 (Step S813), to control the transport path 80 so as to transport the banknotes to the storages 72*a* to 72*c* and the collection storage 71 (Step S814), and to control the inlet/outlet 61 so as to close the shutter (Step S815), and ends the process.

Process Upon Depositing Money in Banknote Handling Machine

As shown in FIG. 9, when accepting an instruction to start a depositing process through the input unit 90 (YES at Step S901), the banknote handling machine 50 causes the transport controller 122 to control the depositing/dispensing mechanism 62 so as to feed the banknote put inside thereof into the transport path 80 (Step S902). The banknote handling machine 50 causes the transport controller 122 to control the transport path 80 so as to transport the banknote to the recognition/determination mechanism 63 (Step S903).

The banknote handling machine 50 causes the recognition/determination mechanism controller 123 to control the recognition/determination mechanism 63 to recognize the banknote (Step S904). If the banknote is the rejected note (YES at Step S905), the banknote handling machine 50 causes the transport controller 122 to control the transport path 80 so as to transport the banknote to the inside of the depositing/dispensing mechanism 62 (Step S906). Meanwhile, if the banknote is anything other than the rejected note as a result of recognition (NO at Step S905), the banknote handling machine 50 increases and updates the number-of-sheets information stored in the relevant cell of the matrix table stored in the storage-management-table memory 111 (Step S907). The banknote handling machine 50 causes the transport controller 122 to control the transport path 80 so as to transport the banknote to the escrow unit 64 (Step S908).

When a predetermined time has passed after all the banknotes put inside the depositing/dispensing mechanism 62 are fed into the transport path 80 (YES at Step S909), the banknote handling machine 50 causes the transport controller 122 to control the inlet/outlet 61 so as to open the shutter (Step S910), and displays a space for confirmation of the deposited amount of money on the touch panel of the input unit 90 and stands by (Step S911). When receiving a signal indicating confirmation of the deposited amount of money through the input unit 90 (YES at Step S911), the banknote handling machine 50 closes the shutter (Step S912), controls the transport controller 122 to control the escrow unit 64 so as to feed the banknotes held inside thereof into the transport path 80 (Step S913), controls the transport path 80 so as to transport the banknotes to the storages 72*a* to 72*c* and the collection storage 71 (Step S914), and ends the process.

Process of Banknote Handling Machine Upon Removal of Banknote Storage

As shown in FIG. 10, when accepting the removal request of the storage through the input unit 90 (YES at Step S1001), the banknote handling machine 50 causes the banknote-storage removal controller 124 to read the number-of-sheets information stored in the cell of the matrix table associated with the storage identification information for the storage as an object to be removed, from the storage-management-table memory 111 (Step S1002). The banknote handling machine 50 causes the banknote-storage removal controller 124 to transmit the read number-of-sheets information together with the classification information and the denomination information both of which determine the cell in which the number-of-sheets information is stored, and instruct the storage as the object to be removed to write the read number-of-sheets information thereinto (Step S1003). When the banknote-storage removal controller 124 finishes transmission of the number-of-sheets information for all the cells in the matrix table and the write is completed (YES at Step S1004), the banknote handling machine 50 also controls the banknote-storage removal controller 124 to unlock the connection portion to the storage as the object to be removed (Step S1005), and ends the process.

Process of Banknote Handling Machine Upon Attachment of Banknote Storage

As shown in FIG. 11, when a storage is attached to a specified mounting location and a read instruction of the number-of-sheets information stored in the storage is accepted through the input unit 90 (YES at Step S1101), the banknote handling machine 50 causes the banknote-storage attachment controller 125 to instruct transmission of the storage identification information to the attached storage (Step S1102). The banknote handling machine 50 causes the banknote-storage attachment controller 125 to update the storage identification information associated with the mounting-location identification information for a mounting position, to the received storage identification information (Step S1103). The banknote handling machine 50 causes the banknote-storage attachment controller 125 to specify the cell and instruct transmission of the number-of-sheets information to the attached storage (Step S1104) and update the number-of-sheets information with the number-of-sheets information received from the storage (Step S1105). When depositing the number-of-sheets information for all the cells is finished (YES at Step S1106), the banknote handling machine 50 displays the information indicating completion of the attachment process on the touch panel of the input unit 90 (Step S1107), and ends the process.

Effect of Second Embodiment

As explained above, according to the second embodiment, there are mounted the banknote storages each of which recognizes the denomination being a kind of a banknote and a category being a classification based on the feature quantities of the banknote, stores banknotes inside thereof, and includes the memory that stores therein the number-of-sheets information for the banknotes stored inside thereof by denomination and by category recognized by the recognition/determination mechanism. The number-of-sheets information for the banknotes sorted into those for each banknote storage and stored in each of the banknote storages is stored by denomination and by category recognized by the recognition/determination mechanism. Therefore, it is possible to determine the number of banknotes stored in the banknote storage by denomination and by category and to add new trace information for identifying the user, when the counterfeit note or the suspect note is taken in, to the information.

According to the second embodiment, when a banknote storage is attached to the banknote handling machine, the number-of-sheets information stored in the memory of the banknote storage is updated in association with the banknote storage. When a banknote is fed out of the banknote storage, the stored number-of-sheets information is updated according to the result of recognition of the banknote performed by the recognition/determination mechanism. When a banknote storage is removed from the banknote handling machine, the memory of the banknote storage is overwritten with the number-of-sheets information stored in association with the banknote storage, to thereby update the number-of-sheets information stored in the memory. Therefore, it is possible to attach and remove the storage to and from the banknote handling machine, and also determine the number of banknotes stored in each storage in the banknote handling machine by denomination and by category when the storage is attached thereto and removed therefrom. Moreover, it is possible to determine the number of banknotes stored in the removed storage by denomination and by category.

According to the second embodiment, the number-of-sheets information is stored by category, the category being classified into the first category as the genuine and fit note, the second category as the genuine and unfit note, the third category as the suspect note, the fourth category as the counterfeit note, and the fifth category as the rejected note, based on a combination of the first feature quantity indicating the shape of the banknote as an optical feature quantity obtained by optically measuring the banknote, the second feature quantity indicating an amount or a wavelength of transmissive light or reflected light through/by a banknote, and the third feature quantity indicating a magnetic content contained in the banknote as a magnetic feature quantity obtained by magnetically measuring the banknote. Therefore, it is possible to determine the number of banknotes stored in each storage by denomination and by definition of ECB in both the storage and the banknote handling machine.

According to the second embodiment, the storage includes the memory that stores therein the number-of-sheets information by category, the category being classified into the first category as the genuine and fit note, the second category as the genuine and unfit note, the third category as the suspect note, the fourth category as the counterfeit note, and the fifth category as the rejected note, based on a combination of the first feature quantity indicating corner-fold or an amount of a missing part of the banknote as an optical feature quantity obtained by optically measuring the banknote, the second feature quantity indicating an attenuation of infrared rays of transmissive light or reflected light through/by the banknote, and the third feature quantity indicating a magnetic content contained in a serial-number printed portion, a portrait portion, and a denomination printed portion on the banknote, as a magnetic feature quantity obtained by magnetically measuring the banknote. Therefore, it is possible to determine the number of banknotes stored in each storage by denomination and by definition of ECB in both the storage and the banknote handling machine and to add new trace information for identifying the user, when the counterfeit note and the suspect note are taken-in, to the information.

Third Embodiment

The embodiments according to the present invention have been explained so far, however, the present invention may be executed in various different embodiments other than the embodiments. Therefore, different embodiments will be explained by being classified into (1) to (5) as explained below.

(1) Feature Quantity

The embodiments have explained numerical values or quantities obtained by measuring the banknote by using the first feature quantity, the second feature quantity, and the third feature quantity, however, the present invention is not limited thereto. Therefore, any values may be used if a banknote is measured by using a predetermined method to obtain numerical values or quantities. For example, information obtained by photographing a banknote, acquiring an image thereof, and analyzing data for the image may be used.

(2) Category

The embodiments have explained the case in which the five classifications defined by ECB are applied as the categories into which banknotes are sorted, however, the present invention is not limited thereto. Therefore, any classification may be used if the classification is performed based on the feature quantities of the banknote. For example, the categories composed of four classifications except for "suspect note" may be applied.

(3) Configuration of Storage

The second embodiment has explained the configuration of the storage that stores therein banknotes, as one including the escrow unit 64 that temporarily holds the banknote recognized by the recognition/determination mechanism 63 upon dispensing money, and the collection storage 71 that collectively stores therein banknotes of mixed denominations. However, the present invention is not limited thereto. Therefore, the storage may be formed with any one of or a plurality of storages among those such as a temporary-dispensing-holding storage that temporarily holds the banknotes recognized by the recognition/determination mechanism 63 upon dispensing money, a mixed denomination storage that collectively stores therein the banknotes of mixed denominations, a depositing-suspect-note storage that stores therein the banknote determined as the third category by the recognition/determination mechanism 63 upon depositing money, a depositing-counterfeit-note storage that stores therein the banknote determined as the fourth category by the recognition/determination mechanism 63 upon depositing money, a dispensing-suspect-note storage that stores therein the banknote determined as the third category by the recognition/determination mechanism 63 upon dispensing money, a dispensing-counterfeit-note storage that stores therein the banknote determined as the fourth category by the recognition/determination mechanism 63 upon dispensing money, and a dispensing-rejected-note storage that stores therein the banknote determined as the fifth category by the recognition/determination mechanism 63 upon dispensing money.

(4) Setting of Denomination

The second embodiment has explained the case in which the denomination to be stored in the banknote storage mounted in the mounting location is preset for each mounting location, however, the present invention is not limited thereto. Therefore, the banknote storage that stores therein banknotes of a single denomination may be mounted in any location regardless of mounting locations.

This case will be explained below. When a specified storage is attached to the banknote handling machine 50, the banknote-storage attachment controller 125 newly stores the number-of-sheets information stored in the memory of the storage associated with the storage in the storage-management-table memory 111, to thereby update the number-of-sheets information, and stores the denomination information for identifying a single denomination of banknotes stored in the storage associated with the storage in the storage-management-table memory 111.

Explanation is made by using a specific example. When a banknote storage that stores therein 10000-yen notes and whose storage identification information is "5" is mounted in the mounting location indicated by mounting-location identification information "B", the banknote-storage attachment controller 125 causes the storage-management-table memory 111 to update the storage identification information corresponding to the mounting-location identification information "B" from "2" to "5", update the number-of-sheets information in each cell of the matrix table to the number-of-sheets information stored in the memory of the banknote storage, and further update stored-denomination information "1000 yen" to the denomination information "10000 yen" corresponding to only the cell which stores therein the number-of-sheets information in the matrix table of the memory of the banknote storage. By doing so, even if the storage with banknotes of a single denomination stored therein is mounted in any mounting location, a taken-in banknote is stored in a storage that stores therein banknotes of the same denomination as that of the taken-in banknote without error upon depositing money, and a banknote can be dispensed without error from the storage that stores therein banknotes of the denomination required for the dispensed amount.

(5) System Configuration or the Like

The components of the shown devices are functionally conceptual, and thus they are not necessarily the same as physically shown ones. More specifically, specific formation of dispersion and integration of the devices is not necessarily limited to the shown ones. The components can be configured by functionally or physically dispersing or integrating the entire or part of the components by arbitrary units according to various loads and use patterns, for example, by integrating the banknote-storage removal controller 124 with the banknote-storage attachment controller 125. Furthermore, the entire or arbitrary part of the processing functions performed by the devices are implemented by CPU and by programs analyzed and executed by the CPU, or can be implemented as hardware based on wired logic.

INDUSTRIAL APPLICABILITY

As explained above, the banknote storage according to the present invention is useful for the case in which it is mounted in a banknote handling machine that manages depositing and dispensing of banknotes, and is suitable for determination of the stored number of banknotes by denomination and by category.

The invention claimed is:

1. A banknote storage mounted on a banknote handling machine that manages depositing and dispensing of a banknote, the banknote storage comprising:

a memory unit of the banknote storage that stores therein number-of-sheets information for banknotes stored inside of the banknote storage, wherein the number-of-sheets information is stored by denomination, being a kind of the banknotes, and by category, being a classification based on a feature quantity of the banknotes.

2. The banknote storage according to claim 1, further comprising a communication unit that writes, when accepting a write instruction of number-of-sheets information to the memory unit of the banknote storage from an external device, the number-of-sheets information to the memory unit of the banknote storage based on the write instruction, and that reads, when accepting a read instruction of number-of-sheets information of the memory unit of the banknote storage from the external device, the number-of-sheets information from the memory unit of the banknote storage based on the read instruction, and transmits the read information to the external device.

3. A banknote handling machine comprising the banknote storage according to claim 1, the banknote handling machine further comprising:

a recognizing unit that recognizes a denomination being a kind of the banknote and a category being a classification based on a feature quantity of the banknote.

4. The banknote handling machine according to claim 3, wherein the memory unit of the banknote storage stores therein the number-of-sheets information by category, the category being classified into a first category as a genuine and fit note, a second category as a genuine and unfit note, a third category as a suspect note, a fourth category as a counterfeit note, and a fifth category as a rejected note, based on a combination of a first feature quantity indicating a shape of the banknote as an optical feature quantity obtained by optically measuring the banknote, a second feature quantity indicating an amount or a wavelength of transmissive light or reflected light through/by the banknote, and a third feature quantity indicating a magnetic content contained in the banknote as a magnetic feature quantity obtained by magnetically measuring the banknote.

5. The banknote handling machine according to claim 4, wherein the banknote storage is formed with any one of or a plurality of storages, the storages being a temporary-depositing-holding storage that temporarily holds the banknote recognized by the recognizing unit upon depositing money, a temporary-dispensing-holding storage that temporarily holds the banknote recognized by the recognizing unit upon dispensing money, a mixed denomination storage that collectively stores therein the banknotes of mixed denominations, a depositing-suspect-note storage that stores therein the banknote determined as the third category by the recognizing unit upon depositing money, a depositing-counterfeit-note storage that stores therein the banknote determined as the fourth category by the recognizing unit upon depositing money, a dispensing-suspect-note storage that stores therein the banknote determined as the third category by the recognizing unit upon dispensing money, a dispensing-counterfeit-note storage that stores therein the banknote determined as the fourth category by the recognizing unit upon dispensing money, and a dispensing-rejected-note storage that stores therein the banknote determined as the fifth category by the recognizing unit upon dispensing money.

6. The banknote handling machine according to claim 3, wherein the memory unit of the banknote storage stores therein the number-of-sheets information by category, the category being classified into a first category as a genuine and fit note, a second category as a genuine and unfit note, a third category as a suspect note, a fourth category as a counterfeit note, and a fifth category as a rejected note, based on a combination of a first feature quantity indicating corner-fold or an amount of a missing part of the banknote as an optical feature quantity obtained by optically measuring the banknote, a second feature quantity indicating an attenuation of infrared rays of transmissive light or reflected light through/by the banknote, and a third feature quantity indicating a magnetic content contained in a serial-number printed portion, a portrait portion, and a denomination printed portion on the banknote, as a magnetic feature quantity obtained by magnetically measuring the banknote.

7. The banknote handling machine according to claim 3, further comprising:

a memory unit of the banknote handling machine that stores therein number-of-sheets information for banknotes which are sorted and stored into each banknote storage unit of a plurality of banknote storage units, by denomination and by category recognized by the recognizing unit;

a first updating unit that newly stores, when the banknote storage is attached to the banknote handling machine, the number-of-sheets information stored in the memory unit of the banknote storage, by being associated with the banknote storage, to thereby update the number-of-sheets information stored in the memory unit of the banknote handling machine;

a second updating unit that updates, when a banknote is fed into the banknote storage or when a banknote is fed out of the banknote storage, number-of-sheets information stored in the memory unit of the banknote handling machine according to a banknote recognition result performed by the recognizing unit; and a third updating unit that overwrites, when the banknote storage is removed from the banknote handling machine, the memory unit of the banknote storage with the number-of-sheets information associated with the banknote storage stored in the memory unit of the banknote handling machine, to thereby update the number-of-sheets information stored in the memory unit of the banknote storage.

8. The banknote handling machine according to claim 3, wherein a plurality of banknote storages in which banknotes are stored by denomination is formed in the banknote handling machine, the banknote handling machine further comprises:

a first updating unit that newly stores, when a banknote storage is attached to the banknote handling machine, the number-of-sheets information stored in the memory unit of the banknote storage, by being associated with the banknote storage, to thereby update the number-of-sheets information stored in a memory unit of the banknote handling machine, and that stores denomination information for identifying a single denomination stored in the banknote storage associated with the banknote storage, in the memory unit of the banknote handling machine;

a feed-in unit that selects, upon depositing of a banknote, a banknote storage into which the banknote is to be fed according to a banknote recognition result by the recognizing unit and the denomination information stored in the memory unit of the banknote handling machine, and that feeds the banknote into the selected banknote storage;

a feed-out unit that selects, upon dispensing of a banknote, a banknote storage of which the banknote is fed out according to the denomination information stored in the memory unit of the banknote handling machine, and that feeds out the banknote from the selected banknote storage under a condition that a banknote recognition result of the fed-out banknote by the recognizing unit matches the denomination information;

a second updating unit that updates, when a banknote is fed into the banknote storage by the feed-in unit or when a banknote is fed out of the banknote storage by the feed-out unit, number-of-sheets information stored in the memory unit of the banknote handling machine according to a banknote recognition result by the recognizing unit; and a third updating unit that overwrites, when the banknote storage is removed from the banknote handling machine, the memory unit of the banknote storage with the number-of-sheets information stored in the memory unit of the banknote handling machine associated with the banknote storage, to thereby update the number-of-sheets information stored in the memory unit of the banknote storage.

9. A banknote storage mounted on a banknote handling machine that manages depositing and dispensing of a banknote, the banknote storage comprising:

a memory unit of the banknote storage that stores therein number-of-sheets information for banknotes stored inside of the banknote storage by denomination, being a kind of the banknotes, and by category, being a classification based on a feature quantity of the banknotes, wherein the memory unit of the banknote storage stores therein the number-of-sheets information by category, the category being classified into a first category as a genuine and fit note, a second category as a genuine and unfit note, a third category as a suspect note, a fourth category as a counterfeit note, and a fifth category as a rejected note, based on a combination of a first feature quantity indicating a shape of the banknote as an optical feature quantity obtained by optically measuring the banknote, a second feature quantity indicating an amount or a wavelength of transmissive light or reflected light through/by the banknote, and a third feature quantity indicating a magnetic content contained in the banknote as a magnetic feature quantity obtained by magnetically measuring the banknote.

10. A banknote storage mounted on a banknote handling machine that manages depositing and dispensing of a banknote, the banknote storage comprising:

a memory unit of the banknote storage that stores therein number-of-sheets information for banknotes stored inside of the banknote storage by denomination, being a kind of the banknotes, and by category, being a classification based on a feature quantity of the banknotes, wherein the memory unit of the banknote storage stores therein the number-of-sheets information by category, the category being classified into a first category as a genuine and fit note, a second category as a genuine and unfit note, a third category as a suspect note, a fourth category as a counterfeit note, and a fifth category as a rejected note, based on a combination of a first feature quantity indicating corner-fold or an amount of a missing part of the banknote as an optical feature quantity obtained by optically measuring the banknote, a second feature quantity indicating an attenuation of infrared rays of transmissive light or reflected light through/by the banknote, and a third feature quantity indicating a magnetic content contained in a serial-number printed portion, a portrait portion, and a denomination printed portion on the banknote, as a magnetic feature quantity obtained by magnetically measuring the banknote.

* * * * *